US010723523B2

(12) United States Patent
Trahan et al.

(10) Patent No.: US 10,723,523 B2
(45) Date of Patent: Jul. 28, 2020

(54) TAMPER EVIDENT CONTAINER HAVING BONDED TAB

(71) Applicant: Fabri-Kal Corporation, Kalamazoo, MI (US)

(72) Inventors: Jason Trahan, Plainwell, MI (US); Mike Hanson, Augusta, MI (US); Josh Shaw, Paw Paw, MI (US); Rodger Gibson, Otsego, MI (US); Alex Proidan, Chattanooga, TN (US)

(73) Assignee: FABRI-KAL CORPORATION, Kalamazoo, MI (US)

( * ) Notice: Subject to any disclaimer, the term of this patent is extended or adjusted under 35 U.S.C. 154(b) by 65 days.

(21) Appl. No.: 15/866,245

(22) Filed: Jan. 9, 2018

(65) Prior Publication Data

US 2018/0327148 A1 Nov. 15, 2018

Related U.S. Application Data

(60) Provisional application No. 62/444,799, filed on Jan. 10, 2017.

(51) Int. Cl.
*B65D 43/02* (2006.01)

(52) U.S. Cl.
CPC ..... *B65D 43/022* (2013.01); *B65D 43/021* (2013.01); *B65D 2101/00* (2013.01);
(Continued)

(58) Field of Classification Search
CPC ..... B65D 43/022; B65D 43/0216; B65D 43/0214; B65D 43/021; B65D 39/16;
(Continued)

(56) References Cited

U.S. PATENT DOCUMENTS 2,972,432 A * 2/1961 Flack ..... B65D 21/0219 220/380
3,339,786 A * 9/1967 Biglin ..... B65D 43/0212 220/781

(Continued)

FOREIGN PATENT DOCUMENTS

DE 102014100657 A1 * 7/2015 ..... B65D 43/022
EP 1336569 8/2003

(Continued)

OTHER PUBLICATIONS

Schomberg, All posts by Katie Schomberg, AptarGroup Newsroom, 2016.

(Continued)

*Primary Examiner* — Robert J Hicks
(74) *Attorney, Agent, or Firm* — Clark Hill PLC; Adam J. Fromm

(57) ABSTRACT

This invention is a tamper evident container having a base and removable lid comprising a pull tab and a lid surface, wherein the base and lid fit together with an interference fit. The pull tab extends toward the center of the lid surface and away from a base portion of the pull tab, the base portion being located at an edge of the lid. The pull tab further comprises a pull tab portion having a first side that is attached to a first tab marker by a first frangible line, and a second side that is attached to a second tab marker by a second frangible line. The pull tab portion overlays at least one detent that marginally biases the pull tab portion away from the lid surface.

20 Claims, 21 Drawing Sheets

(52) U.S. Cl.
CPC ..... *B65D 2543/00027* (2013.01); *B65D 2543/0049* (2013.01); *B65D 2543/0062* (2013.01); *B65D 2543/0074* (2013.01); *B65D 2543/00101* (2013.01); *B65D 2543/00194* (2013.01); *B65D 2543/00296* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00851* (2013.01); *B65D 2543/00879* (2013.01)

(58) Field of Classification Search
CPC ..... B65D 17/4011; B65D 17/4012; B65D 17/402; B65D 17/404
USPC .... 220/270, 266, 265, 268, 269, 212.5, 781, 220/780, 789, 793, 805, 801, 796; 215/253, 250
See application file for complete search history.

(56) References Cited

U.S. PATENT DOCUMENTS

| | | | |
|---|---|---|---|
| 4,434,908 | A | 3/1984 | French |
| 4,828,137 | A | 5/1989 | Batson et al. |
| 4,942,974 | A | 7/1990 | Larrison |
| 4,966,301 | A | 10/1990 | Yamashita et al. |
| 5,007,231 | A | 4/1991 | Ingemann |
| 5,085,339 | A | 2/1992 | Roth et al. |
| 5,094,357 | A | 3/1992 | McKinney |
| 5,238,134 | A | 8/1993 | Knapp |
| 5,511,680 | A | 4/1996 | Kinne |
| 5,819,969 | A | 10/1998 | Kalodye |
| 5,931,332 | A | 8/1999 | Mygatt et al. |
| 6,142,334 | A | 11/2000 | Kristensson |
| 6,257,435 | B1 | 7/2001 | Chedister et al. |
| 6,428,867 | B1 | 8/2002 | Scott et al. |
| 7,073,680 | B2 | 7/2006 | Boback et al. |
| 7,118,003 | B2 | 10/2006 | Sellari et al. |
| 7,942,286 | B2 | 5/2011 | Sniffer et al. |
| 8,028,851 | B2 | 10/2011 | Vovan et al. |
| 8,186,531 | B2 | 5/2012 | Parikh et al. |
| 8,251,242 | B2 | 8/2012 | Vovan |
| 8,474,651 | B2 | 7/2013 | Simkins |
| 8,640,914 | B2 | 2/2014 | Meyer et al. |
| 8,794,471 | B2 | 8/2014 | Bontrager et al. |
| 8,795,580 | B2 | 8/2014 | Boback et al. |
| 8,833,589 | B2 | 9/2014 | Vovan |
| 9,120,595 | B2 | 9/2015 | Chou |
| 9,278,786 | B2 | 3/2016 | Vovan et al. |
| 9,315,302 | B2 | 4/2016 | Stone et al. |
| 9,409,683 | B2 | 8/2016 | Gingras et al. |
| 9,745,106 | B2 | 8/2017 | Siskindovich et al. |
| 2005/0153026 | A1 | 7/2005 | Mannion et al. |
| 2007/0045317 | A1 | 3/2007 | Rosender et al. |
| 2009/0206082 | A1 | 8/2009 | Vovan |
| 2010/0072217 | A1 | 3/2010 | Parikh et al. |
| 2011/0000929 | A1 | 1/2011 | Brown et al. |
| 2011/0174819 | A1 | 7/2011 | Murphy et al. |
| 2012/0005994 | A1 | 1/2012 | Tidball et al. |
| 2013/0068654 | A1 | 3/2013 | MacDonald |
| 2013/0160406 | A1 | 6/2013 | Johnston |
| 2014/0041343 | A1 | 2/2014 | Corbett et al. |
| 2014/0217100 | A1 | 8/2014 | Nazareth et al. |
| 2014/0231433 | A1 | 8/2014 | Liu |
| 2014/0284346 | A1 | 9/2014 | McCumber |
| 2015/0028033 | A1 | 1/2015 | Samuel |
| 2015/0083725 | A1 | 3/2015 | Sinha et al. |
| 2015/0266611 | A1 | 9/2015 | Dow et al. |
| 2016/0016707 | A1 | 1/2016 | Sellari et al. |
| 2016/0101907 | A1 | 4/2016 | Blackmore et al. |
| 2016/0257454 | A1 | 9/2016 | Myer |

FOREIGN PATENT DOCUMENTS

| | | |
|---|---|---|
| EP | 20300908 | 3/2009 |
| EP | 1725469 | 5/2011 |
| EP | 3040288 | 7/2016 |
| JP | 2007055656 | 3/2007 |
| TW | M518678 | 3/2016 |
| WO | 2005058721 | 6/2005 |
| WO | 2005082733 | 9/2005 |
| WO | 2006119538 | 11/2006 |
| WO | 2010085318 | 7/2010 |
| WO | 2011080182 | 7/2011 |
| WO | 2013077732 | 5/2013 |
| WO | 2014043811 | 3/2014 |
| WO | 2015117761 | 8/2015 |
| WO | 2016067307 | 5/2016 |
| WO | 2016096378 | 6/2016 |

OTHER PUBLICATIONS

Seals enhance customer convenience using non-conventional induction heat sealing liners, Packaging Strategies, BNP Media, 2016.

* cited by examiner

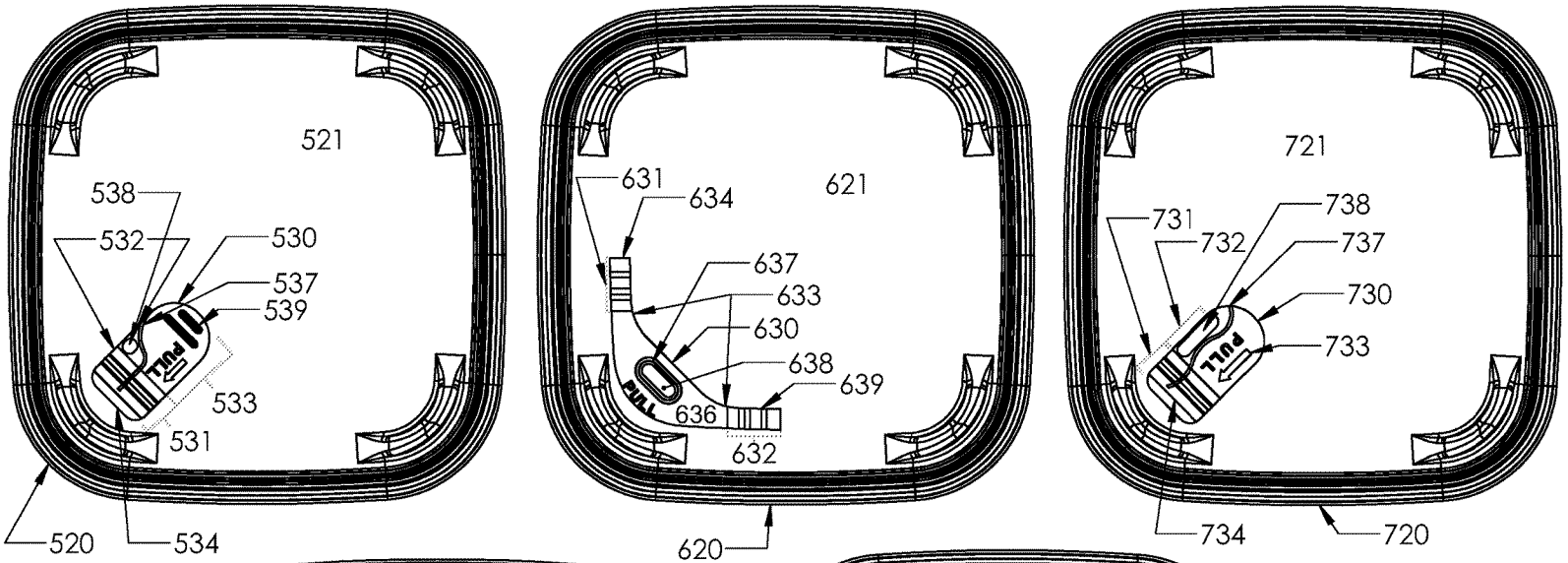
FIGURE 16a
FIGURE 16b
FIGURE 16c
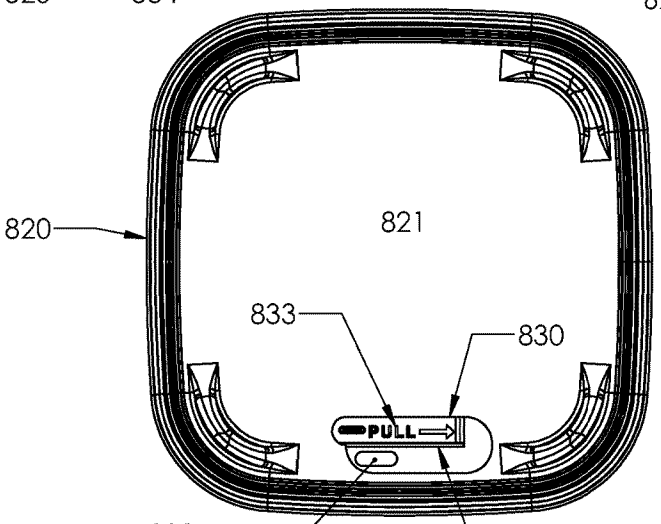
FIGURE 16d
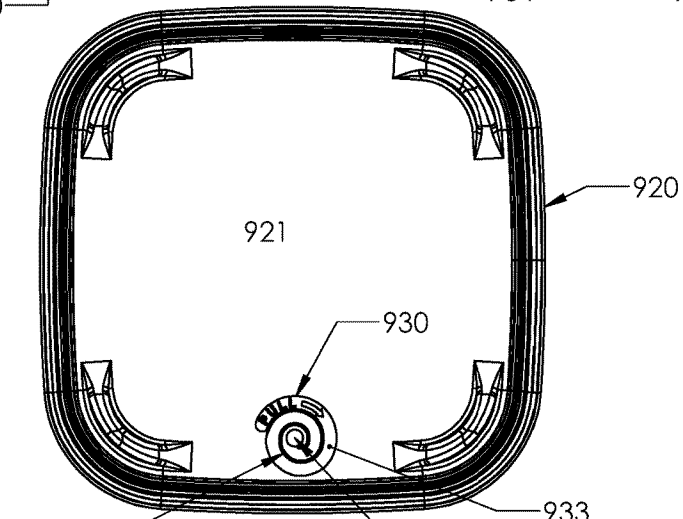
FIGURE 16e

TAMPER EVIDENT CONTAINER HAVING BONDED TAB

CROSS REFERENCE TO RELATED APPLICATIONS

This application claims priority to, and the benefit of, U.S. Provisional Patent Application Ser. No. 62/444,799 filed on Jan. 10, 2017.

FIELD OF THE INVENTION

This invention relates to packages and containers for goods. More specifically, this invention relates to a container comprising a base, a lid, and a tab, wherein the tab is a separate article that is bonded to the lid and may be used to both demonstrate overt evidence of tampering with the container and to disengage the lid from the base.

BACKGROUND OF THE INVENTION

Consumer goods are commonly packaged for sale in polymeric containers. It is highly preferable in most instances that the goods provided in such containers remain pristine after packaging until such time that a consumer opens the container for the first time to expose the contents. This is particularly important when consumer protection and safety are paramount, such as when the goods are hardware or foodstuffs.

Traditional tamper evident packages, including polymeric food containers, provide a variety of tamper evident features. These include tear-away plastic films, tapes, or ribbons that overlay the interface of a lid and base to seal a container, tear-away container bands that guard edges of the container to prevent opening thereof prior to band removal, as well as complementary post and hole configurations. In the case of post and hole configurations, once a container is sealed, it may not be opened under normal circumstances without leaving behind a lid portion, such as post, trapped in a base portion, such as a hole, or vice versa, to provide evidence of container tampering.

There exists a heretofore unmet and pervasive need in the art for a tamper evident container structure that accommodates at least dual tamper evident features of a container. These features may include a hidden (inaccessible) container edge to help inhibit container opening at the edge provided in connection with an overt demonstration of tamper evidence such as a bonded tab marker. Such a need may further be satisfied by a tamper evident container structure that facilitates opening of a container as evidence of tampering is rendered on the container by a user. Moreover, the aforementioned need in the art may be further satisfied by a tamper evidence feature that does not result in the creation of tear-away litter, and that may be positioned as desired on a container lid without regard for other tamper evident features of the container.

SUMMARY OF THE INVENTION

To meet the needs described above, the present disclosure provides a tamper evident container having a tab that is a separate article bonded to a lid of the container at a desired location. A preferred embodiment of the present invention comprises a container having a base, a lid, and a tab. In a closed configuration of the container, such as after goods are sealed within it, the base and the lid are removably connected, the lid comprising a lid rim that is seated within structural boundaries of the base, such as a base seat. This structural arrangement provides a "hidden" lid rim that is substantially inaccessible for opening the container. The hidden lid rim feature also enhances the utility of automation employed for manufacture of the container, and it is important for container leak resistance at the lid rim and nesting of the containers during storage.

The tab of a preferred embodiment of the present invention is preferably a distinct and unitary article that is not integrally formed with the lid. Instead, the tab is preferably bonded by a welding process at first and second tab portions at a preferred location on a lid surface of the lid. The first tab portion comprises a bonded tab base that is bonded to the lid surface. The second tab portion preferably comprises a bonded tab marker that is separably connected to the second tab portion by a frangible line and is also bonded to the lid surface. In alternative preferred embodiments of the present invention, the first tab portion may be bonded to the lid surface using an adhesive, and the second tab portion may comprise a security tape feature in combination with or as a replacement for the bonded tab marker. The tab preferably further comprises a third tab portion that includes a biased feature that is configured to provide a modest deflection of the third tab portion away from the lid surface.

In operation, wherein the hidden lid rim is relatively inaccessible, particularly by a user's finger, the user may seek to open the container by pulling on the tab to unseat the lid from the base. When the user pulls the tab away from the lid, the bonded tab marker will separate from the second tab portion of the tab at the frangible line and remain bonded to the lid surface as overt evidence of tampering with the container. Once the bonded tab marker is separated from the tab, the second tab portion defines a hole through which the user may apply a finger for the purpose of using the tab to pull the lid away from the base by virtue of the bonded tab base. Additionally, the tab will preferably thereafter remain upwardly biased away from the lid surface as further evidence of tampering. The tab may be bonded at a preferred position on the lid surface, and it has been found that preferred embodiments of the present invention that include a tab having its respective bonded tab base provided at a middle lid edge of the lid, as opposed to a lid corner, require a reduction of force to unseat the lid from the base during normal use of the container. In some preferred embodiments, a middle lid edge of the lid may be any portion of a lid having a round profile as opposed to a polygonal one. Moreover, the first tab portion of the tab structure is preferably provided within the footprint of the lid, whether prior to or after tampering has occurred.

A tamper evident container comprising:

a base comprising a base seat;

a lid removably engaged with the base to provide a closed configuration of the container, the lid comprising a lid rim, a lid surface, a plurality of middle lid edges, and at least one detent;

a tab permanently attached to and substantially flush with the lid surface, the tab being a distinct and unitary article comprising a pull tab portion having a first side and a second side, a tab base, first and second tab markers, first and second frangible lines, and a deflector;

wherein the base seat is defined by a seat sidewall, a flange, and a rib corner;

wherein the lid rim is defined by a lid rim sidewall, a lid rim surface, and an outer edge;

wherein the lid rim sidewall contacts the seat sidewall under pressure from the engagement of the base and lid to form an interference fit such that the lid is immobilized in a seated position on the base, and the lid rim is consequently concealed within the structural boundaries of the base seat wherein the lid rim surface is held flush with the flange, and the outer edge is both adjacent to the rib corner and substantially inaccessible, such as by a user's fingers, during normal use of the container when it is in the closed configuration;

wherein the tab is permanently attached to the lid surface at each of the first and second tab markers and at the tab base, the tab base being located substantially parallel to and substantially adjacent to the center of one of the middle lid edges;

wherein the tab base and the pull tab portion are adjoined by the deflector, which is configured to cause the tab to be biased away from the lid surface once the first and second frangible lines are broken; and wherein the pull tab portion extends away from the tab base toward the center of the lid surface, the first side of the pull tab portion being separably attached to the first tab marker by the first frangible line, and the second side of the pull tab portion being separably attached to the second tab marker by the second frangible line, and the pull tab portion overlaying the at least one detent such that, notwithstanding the substantially flush engagement of the tab and the lid surface, the pull tab portion is marginally biased away from the lid surface to render the pull tab accessible by the user's finger.

The tab is configured to provide at least five combined overt sensory indications to the user that the container is being opened for the first time, including: (i) visual evidence of non-tampering defined by (a) the outer edge of the lid rim being both adjacent to the rib corner of the base and substantially inaccessible by the user's fingers, (b) the pull tab portion being modestly biased away from the lid surface by the detent, notwithstanding the substantially flush engagement of the tab and the lid surface, (c) indicia provided on the tab having an unbroken and complete appearance; (ii) tactile evidence of non-tampering defined by an overt tactile sensation produced by the breaking of one or both of the frangible lines; and (iii) auditory evidence of non-tampering defined by the sound that is audible to the user when one or both of the frangible lines is broken.

As used herein, "tampering" is generally defined as the act of interfering with or causing a substantial change to, for example, the above listed sensory indications that otherwise identify the container as being in a pristine condition having not been previously opened by a user.

A preferred embodiment of the present invention is a tamper evident container comprising:

a base comprising a base seat;

a lid removably engaged with the base to provide a closed configuration of the container, the lid comprising a lid rim, a lid surface, and a middle lid edge;

a tab permanently attached to and substantially flush with the lid surface, the tab being a distinct and unitary article comprising a first tab portion, a second tab portion, a third tab portion, wherein the first tab portion further comprises a tab base and a deflector, the second tab portion further comprises a frangible line, and a tab marker, and the third tab portion further comprises a detent and a grip;

wherein the base seat is defined by a seat sidewall, a flange, and a rib corner;

wherein the lid rim is defined by a lid rim sidewall, a lid rim surface, and an outer edge;

wherein the lid rim sidewall contacts the seat sidewall under pressure from the engagement of the base and lid such that the lid is immobilized in a seated position on the base, and the lid rim is consequently concealed within the structural boundaries of the base seat wherein the lid rim surface is held flush with the flange, and the outer edge is both adjacent to the rib corner and substantially inaccessible, such as by a user's fingers, during normal use of the container when it is in the closed configuration;

wherein the tab is permanently attached to the lid surface at both of the tab marker and the tab base, the latter of which is located adjacent and substantially parallel to one of the middle lid edges; and wherein the second and third tab portions extend away from the tab base of the first portion and toward the center of the lid surface, the second portion being separably attached to the tab marker by the frangible line, and third tab portion having the detent, notwithstanding the substantially flush engagement of the tab and the lid surface, is marginally biased away from the lid surface to render the third tab portion accessible by the user's finger.

BRIEF DESCRIPTION OF THE DRAWINGS

FIG. 16A is a top elevational view of a lid and a tab of a container provided in accordance with an alternative embodiment of the present invention, the tab showing another alternative structure and bonded to a location on the lid.

FIG. 16B is a top elevational view of a lid and a tab of a container provided in accordance with an alternative embodiment of the present invention, the tab showing another alternative structure and bonded to a location on the lid.

FIG. 16C is a top elevational view of a lid and a tab of a container provided in accordance with an alternative embodiment of the present invention, the tab showing another alternative structure and bonded to a location on the lid.

FIG. 16D is a top elevational view of a lid and a tab of a container provided in accordance with an alternative embodiment of the present invention, the tab showing another alternative structure and bonded to an alternative location on the lid.

FIG. 16E is a top elevational view of a lid and a tab of a container provided in accordance with an alternative embodiment of the present invention, the tab showing another alternative structure and bonded to an alternative location on the lid.

DETAILED DESCRIPTION OF THE EMBODIMENTS

While the invention has been described with specific embodiments, many alternatives, modifications, and variations will be apparent to those skilled in the art in light of the foregoing description. Accordingly, the present invention is intended to include all such alternatives, modifications, and variations set forth within the spirit and scope of the appended claims. The use of common reference numbers in different figures indicates similar or identical items or features.

Figure 1:
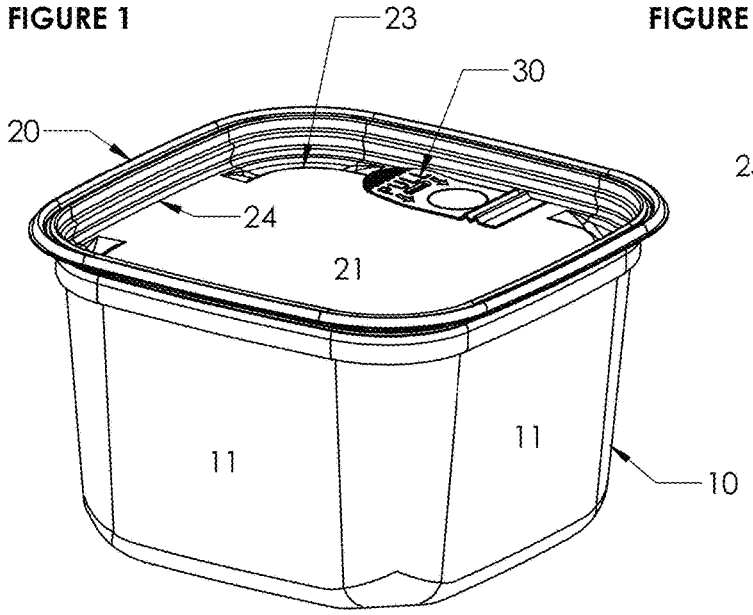
FIG. 1 is a perspective view of a container provided in accordance with a preferred embodiment of the present invention.
Figure 2:
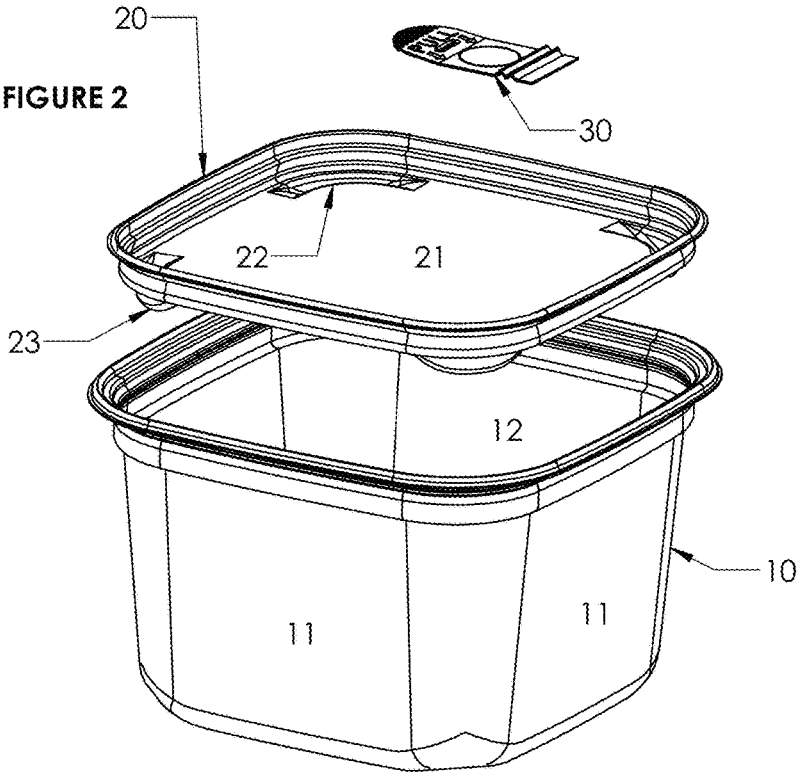
FIG. 2 is an exploded perspective view of a container provided in accordance with a preferred embodiment of the present invention.

FIGS. 1 and 2 show a container 1 provided in accordance with a preferred embodiment of the present invention. As shown, container 1 preferably comprises a base 10, a lid 20, and a tab 30. The container 1 is preferably comprised of a thermoplastic polymer, such as polyethylene terephthalate, and the container 1 may be comprised of other materials suitable for use in thermoformed packaging applications, including polypropylene, high density polyethylene, polylactic acid, and polystyrene. As shown in FIGS. 1 and 2, the base 10 and the lid 20 are preferably complementary structures, wherein the lid 20 is configured to be removably attached to the base 10. Additionally, as shown, when the lid 20 is attached to the base 10, the container 1 may have a substantially cuboid shape, although other preferred embodiments of the present invention may include a container comprising other shapes, such as a cylinder or alternative polyhedrons, as will be further discussed below. As such, preferred embodiments of the present invention may be provided with a lid and a complementary base having at least one of myriad footprints, including substantially square, substantially rectangular, and substantially round.

As further shown in FIGS. 1 and 2, the base 10 of a preferred embodiment of the present invention has a depth and comprises a plurality of walls 11 that define a void suitable for containment of goods, such as food, or other articles as desired. The lid 20 is preferably removably attached to the base 10 to seal the void and define an enclosure 12. The lid 20 further comprises a lid surface 21, lid corners 22, a plurality of lid lugs 23, and a plurality of middle lid edges 24. As shown in FIGS. 1 and 2, the lid surface 21 is a first surface of the lid that is provided opposite to a second surface (not shown) of the lid 20, wherein the second surface faces the void and defines the enclosure 12 when the container 1 is assembled. Although the base 10 and the lid 20 are preferably made by a thermoforming process, such as injection molding, the tab 30 is a separate article that is preferably formed by thermoforming, shaping, coining, or a strapping process. As will be discussed further below, in a preferred embodiment of the present invention, the tab 30 is attached to the lid 20 by welding, use of an adhesive, or other suitable mechanism for bonding thermoplastic components together, such as stitching, gluing, or heat sealing.

Figure 3:
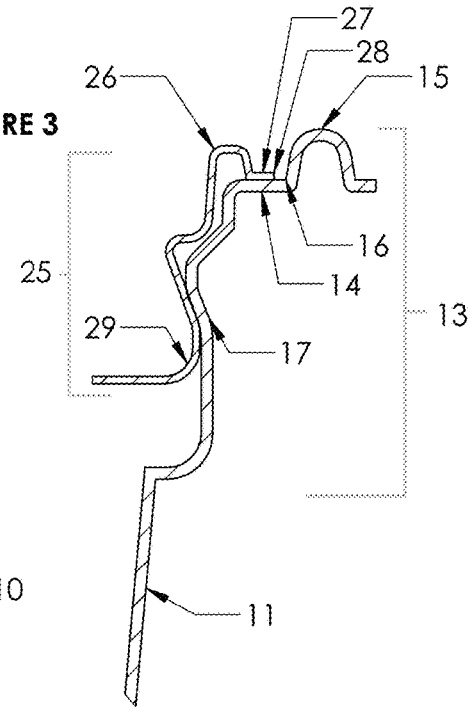
FIG. 3 is a truncated cross-sectional view of a container provided in accordance with a preferred embodiment of the present invention, the view showing a lid rim of the container seated in a base seat of the container.

FIG. 3 is a truncated cross-sectional view of the container 1, provided in accordance with a preferred embodiment of the present invention. The container 1 preferably comprises the base 10 and the lid 20, wherein when the base 10 and the lid 20 are removably connected, and the lid 20 is seated within structural boundaries of the base 10 to provide a "hidden" lid rim 25. As shown in FIG. 3, the structural boundaries of the base 10 preferably comprise a base seat 13, the base seat 13 preferably comprising a base seat flange 14, a base seat rib 15, a base seat rib corner 16, and a base seat sidewall 17. The lid rim 25 preferably comprises a lid rim inner edge 26, a lid rim surface 27, a lid rim outer edge 28, and a lid rim sidewall 29.

As shown in FIG. 3, when the lid 20 is seated on the base 10, lid rim surface 27 is preferably positioned flush with and parallel to base seat flange 14, such that lid rim outer edge 28 approximately abuts the base seat rib corner 16. Pressure at an interface of the lid rim sidewall 29 and the base seat sidewall 17 defines the strength of a bond at an undercut angle that substantially immobilizes the lid 20 in a firmly seated position on the base 10. A preferred consequence of this arrangement is that the lid rim 25 is concealed within the structural boundaries of the base seat 13 such that the lid rim outer edge 28 is relatively inaccessible, such as by a user's fingers, during normal use of the container 1 when it is in a closed configuration and the lid 20 is seated on the base 10 as described above. As such, under normal circumstances, user of the container 1 will preferably be unable to readily open container 1 using the lid rim 25 and will therefore look to remove the lid 20 from the container 1 using other features, particularly the tab 30.

Figure 4:
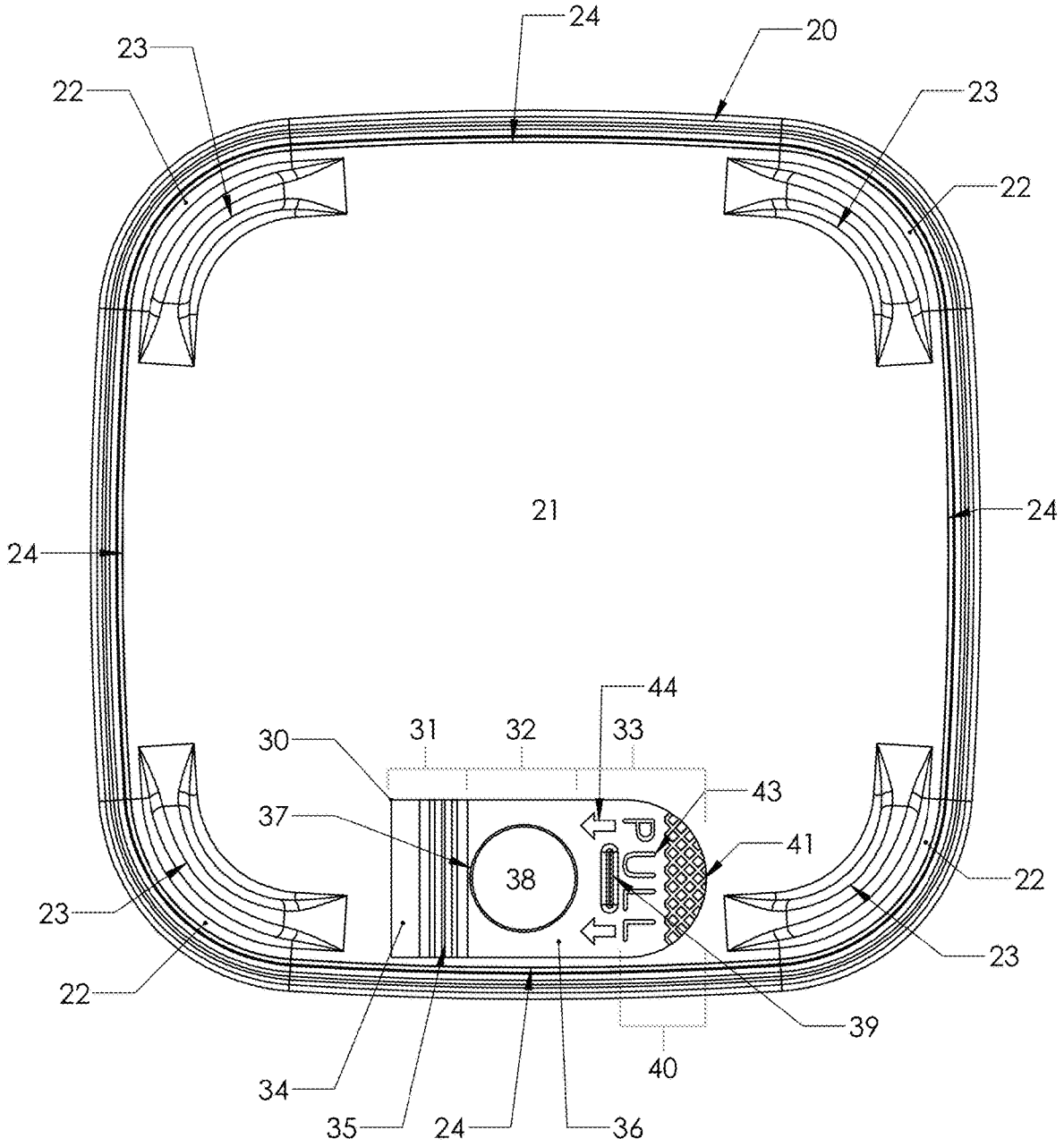
FIG. 4 is a top elevational view of a lid and a tab of a container provided in accordance with a preferred embodiment of the present invention.
Figure 21:
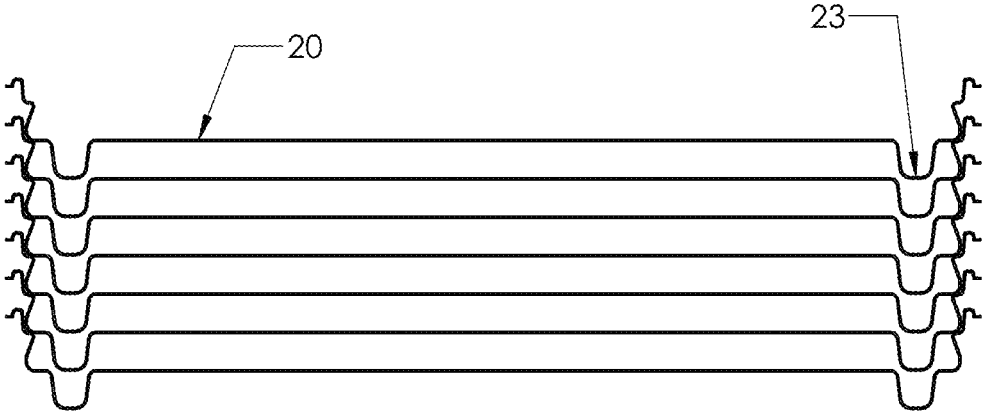
FIG. 21 is a cross-sectional view of a plurality of tabs and lids of a container provided in accordance with an alternative embodiment of the present invention, the tabs and lids shown stacked on top of one another during storage.

FIG. 4 shows the lid 20 and the tab 30 of the container 1 provided in accordance with a preferred embodiment of the present invention. As shown, the lid 20 preferably comprises the lid surface 21 and the plurality of lid lugs 23 provided at the lid corners 22 of the lid 20. In preferred embodiments that include one or more lugs 23, the lugs 23 have complementary configurations that are not limited by a particular geometry and that allow a plurality of lids 20 to be neatly stacked on top of one another during storage and/or shipping (see FIG. 21) wherein the lugs 23 of one lid 20 are nested with the lugs 23 of other lids 20 above and/or below it in the stack. Moreover, the lids 20 may be removed neatly (i.e., dispensed) using automated equipment. Other preferred embodiments of the present invention may exclude the lid lugs 23 and lid corners 22, the latter exclusion occurring such as when a container provided in accordance with the present invention is substantially cylindrical.

As further shown in the preferred embodiment of FIG. 4, the tab 30 is preferably a separate article that is not integrally formed with the lid 20. Instead, the tab 30 is bonded to the lid 20 at a preferred location. As shown, the tab 30 preferably comprises a first tab portion 31, a second tab portion 32, and a third tab portion 33. The first tab portion 31 preferably further comprises a permanently bonded tab base 34 and a deflector 35. The second tab portion 32 preferably further comprises a bridge 36, a frangible line 37, and a bonded tab marker 38. The third tab portion 33 preferably further comprises a detent 39 and a grasping area 40, the grasping area 40 preferably further comprising a grip 41.

As further shown in the preferred embodiment of FIG. 4, the tab 30 is bonded at the first and second tab portions 31, 32 to the lid surface 21. More specifically, the bonded tab base 34 and the bonded tab marker 38 are bonded to the lid surface 21 preferably by a welding process, such as ultrasonic welding, or other bonding mechanism, including the use of an adhesive. The bonded tab base 34 is preferably bonded to the lid surface 21 along one of the middle lid edges 24, although alternative preferred embodiments of the present invention may comprise a tab bonded to a lid at a lid corner, as will be discussed further below.

As yet further shown in the preferred embodiment of FIG. 4, the deflector 35 at the first tab portion 31 is preferably a substantially ridged structure that extends transversely across the tab 30 at the first tab portion 31. In a preferred embodiment of the present invention, the third tab portion 33 further comprises a symbol, such as the word "PULL" 43 inscribed thereon, along with one or more arrows 44 that point in a preferred direction for the tab 30 to be pulled by a user. Alternative embodiments of the present invention may include other indicia at the third tab portion 33. The second tab portion 32 preferably connects the first and third tab portions 31, 33, and the bridge 36 is separably attached to the bonded tab marker 38 at the frangible line 37. It is contemplated that the bonded tab marker 38 may comprise myriad alternative geometric shapes, including the circle as shown in the preferred embodiment of FIG. 4, or polygons. The third tab portion 33 comprises the detent 39, which is a biased feature of the tab 30 that is configured to preferably provide a modest bias of the third tab portion 33 away from the lid surface 21. Although one detent 39 is shown in the preferred embodiment of FIG. 4, it is contemplated that a tab of an alternative embodiment of the present invention may comprise a plurality of detents. Moreover, it is contemplated that the detent 39 may comprise myriad shapes suited to its purpose. In a preferred embodiment of the present invention, the grip 41 comprises a cross-hatch pattern scored about the material comprising the grip 41. It is contemplated that alternative embodiments of the present invention may exclude a cross-hatched grip.

Figure 5A:
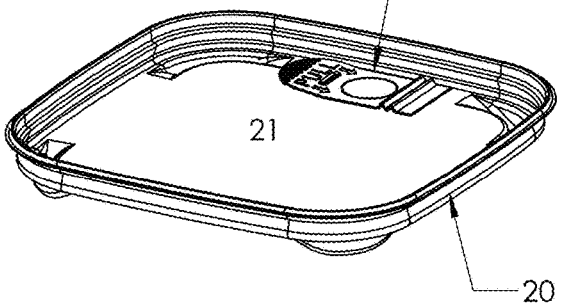
FIG. 5A is a perspective view of a lid and a tab of a container provided in accordance with a preferred embodiment of the present invention, the tab shown prior to tampering.
Figure 5B:
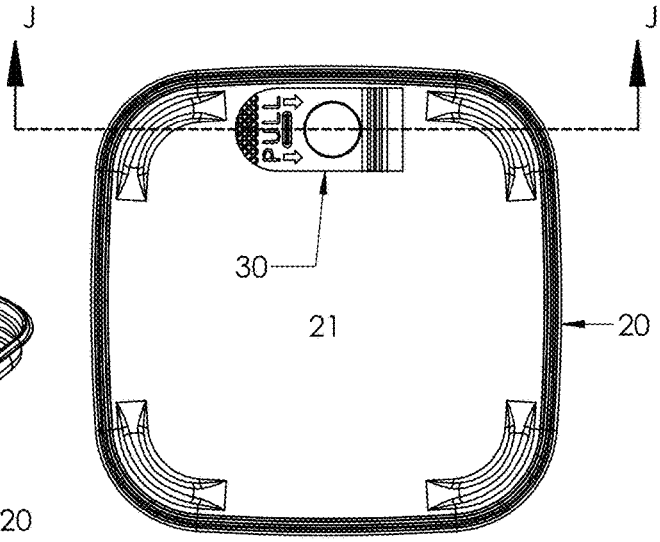
FIG. 5B is a top elevational view of a lid and a tab of a container provided in accordance with a preferred embodiment of the present invention and including section line J-J, the tab shown prior to tampering.
Figure 5C:
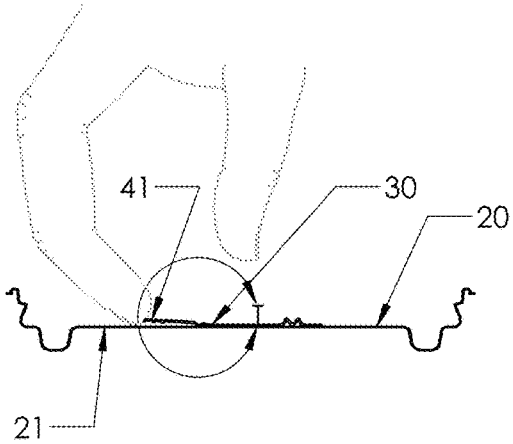
FIG. 5C is a cross-sectional view on section line J-J of a lid and a tab of a container provided in accordance with a preferred embodiment of the present invention, the tab shown prior to tampering.
Figure 5D:
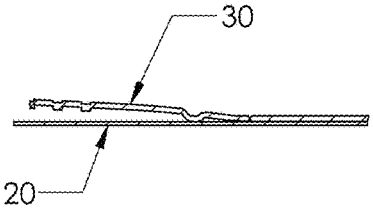
FIG. 5D is a cross-sectional view at detail T of FIG. 5C showing a lid and a tab of a container provided in accordance with a preferred embodiment of the present invention, the tab shown prior to tampering.

In operation, a preferred embodiment of the present invention comprises container 1, wherein goods (not shown) have been made to occupy the void defined by the walls 11 of base 10, and the lid 20 is seated on the base 10 to seal the enclosure 12 in a closed configuration with the goods inside the container 1. Because the hidden lid rim 25 is disposed in the base seat 13, the lid rim outer edge 28 is relatively inaccessible, particularly by a user's finger. Therefore, the user may grasp the grasping area 40, including the grip 41, of the tab 30 and pull the tab 30 away from the lid surface 21. FIGS. 5A-D show a lid 20 and tab 30 provided in accordance with a preferred embodiment of the present invention. As shown in FIGS. 5B-C at Section J-J, the grip 41 is modestly biased away from the lid surface 21 by the detent 39 and accessible by a tip of the user's finger. FIG. 5D provides another view of the tab 30 at detail T of FIG. 5C, the tab 30 being modestly biased away from the lid 20 for access by a user's finger before the tab 30 is pulled away from the lid 20.

Figure 6A:
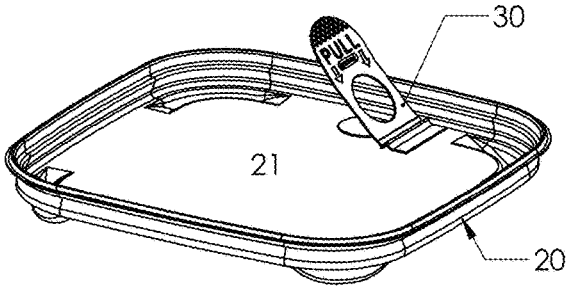
FIG. 6A is a perspective view of a lid and a tab of a container provided in accordance with a preferred embodiment of the present invention, the tab shown after tampering.
Figure 6B:
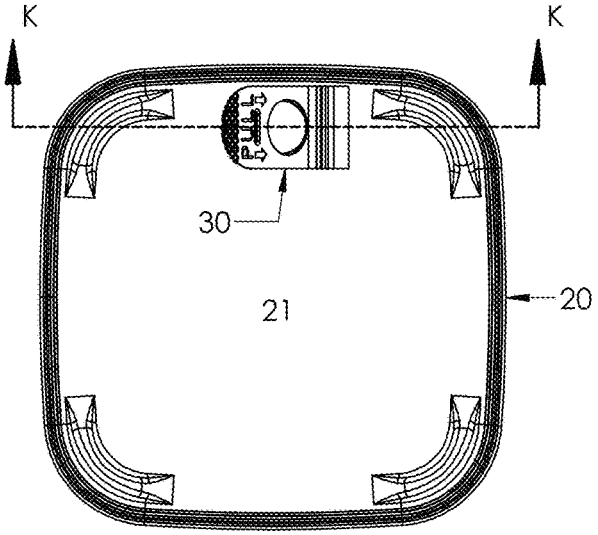
FIG. 6B is a top elevational view of a lid and a tab of a container provided in accordance with a preferred embodiment of the present invention and including section line K-K, the tab shown after tampering.
Figure 6C:
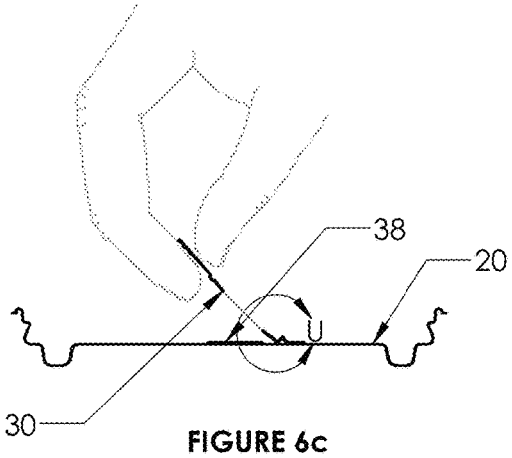
FIG. 6C is a cross-sectional view on section line K-K of a lid and a tab of a container provided in accordance with a preferred embodiment of the present invention, the tab shown after tampering.
Figure 6D:
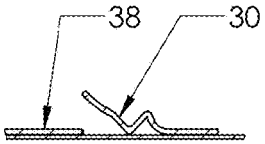
FIG. 6D is a cross-sectional view at detail U of FIG. 6C showing a lid and a tab of a container provided in accordance with a preferred embodiment of the present invention, the tab shown after tampering.

When the user pulls the tab 30 away from the lid surface 21, preferably in the direction designated by "PULL" 43 insignia and adjacent arrows 44, the bonded tab marker 38, which is bonded to the lid surface 21, will separate from the tab 30 at the frangible line 37, and the tab 30 will preferably pivot about an interface of the deflector 35 and the bonded tab base 34. As shown in FIGS. 6A-D, in normal operation, the bonded tab marker 38 will completely separate from the tab 30 and remain bonded to the lid surface 21 as overt evidence of tampering with the container 1. Additionally, as shown in FIGS. 6B-C, and particularly at Section K-K, once the bonded tab marker 38 is no longer integrally connected to the tab 30 about the frangible line 37, the tab 30 will preferably remain upwardly biased away from the lid surface 21 to provide further evidence of tampering. FIG. 6D provides another view of the tab 30 at detail U of FIG. 6C, the tab 30 being upwardly biased away from the lid 20 after tampering, and the bonded tab marker 38 being left behind and attached to the lid surface 21. Once the tab 30 is pulled open, the deflector 35 helps to spring the tab 30 up to show that it is separated from the lid surface 21 and the bonded tab marker 38, thereby providing further overt evidence of lid 20 tampering. It has been found that the act of pulling the tab 30 creates a natural distortion and stress deformation at the bonded tab base 34 that keeps the tab 30 substantially biased away from the lid surface 21 after tampering as shown in FIG. 6A. The structure of deflector 35 further supports this biasing away of the tab 30 from the lid 20 after tampering.

To provide further evidence of tampering, it is contemplated that tab 30 may comprise a different color than other constituent portions of the container 1, particularly the lid 20. As such, the bonded tab marker 38 is overtly visible after tampering, particularly on a lid 20 of contrasting color. It is further contemplated that the tab 30 may be provided with alternative textures and/or a frosted appearance to enhance the overt visual characteristics of the tab 30.

As shown with particularity in FIGS. 5A-B and 6A-B, whether the prior to or after tampering, the tab 30 is preferably contained within the footprint of lid 20. For example, the structure of tab 30 is preferably maintained within the lateral boundaries of the lid rim outer edge 28.

Figure 7:
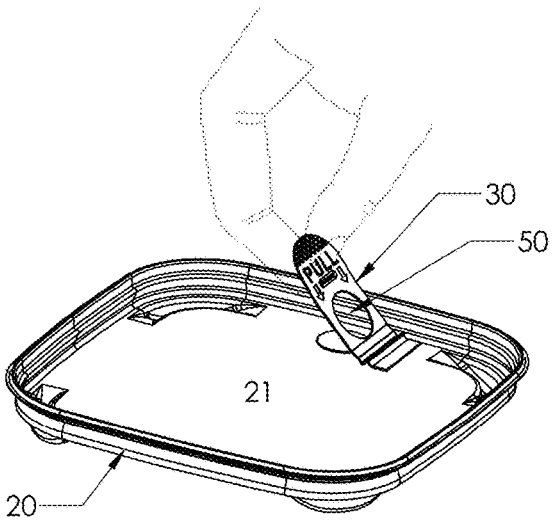
FIG. 7 is a perspective view of a lid and a tab of a container provided in accordance with a preferred embodiment of the present invention, the tab shown after tampering.
Figure 8:
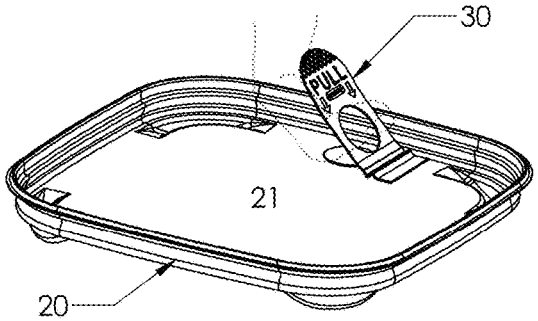
FIG. 8 is a perspective view of a lid and a tab of a container provided in accordance with a preferred embodiment of the present invention, the tab shown after tampering and defining a finger hole.
Figure 9:
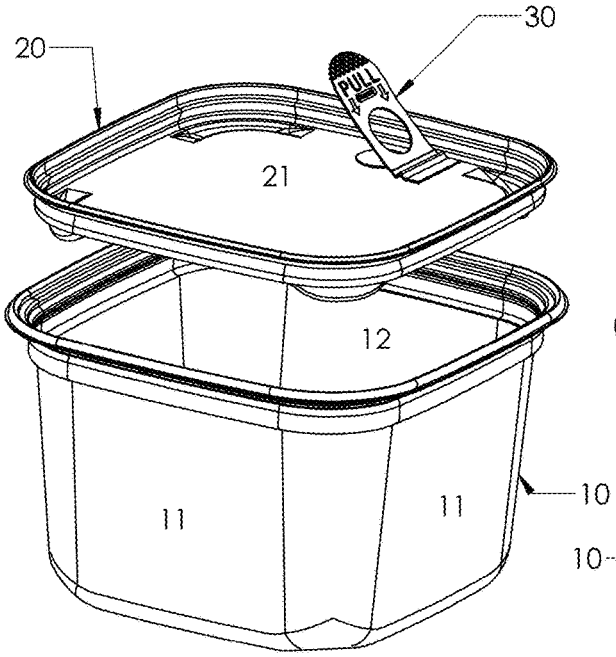
FIG. 9 is an exploded perspective view of a container provided in accordance with a preferred embodiment of the present invention, a tab of the container shown after tampering.
Figure 10:
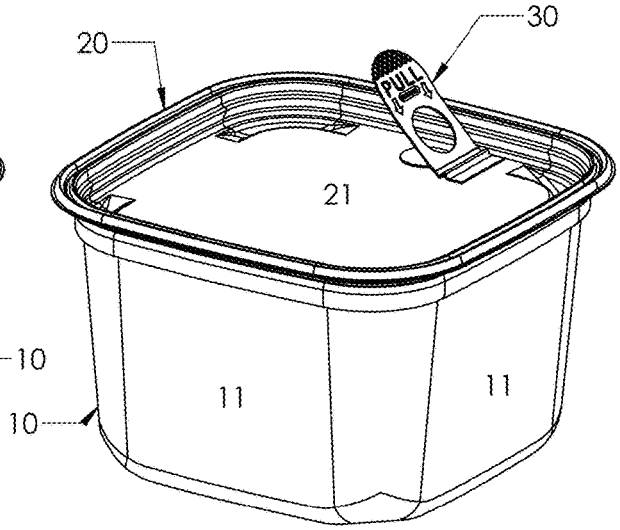
FIG. 10 is a perspective view of a container provided in accordance with a preferred embodiment of the present invention, a tab of the container shown after tampering.

As further shown in the preferred embodiment of the present invention depicted in FIGS. 7 and 8, once the bonded tab marker 38 is separated from the tab 30, the bridge 36 preferably defines a finger hole 50. As shown in FIGS. 7 and 8, a user may therefore provide a finger through the finger hole 50 and use the tab 30 to pull the lid 20 from the base 10, thereby making accessible the goods housed within the enclosure 12. FIG. 9 shows a preferred embodiment of the present invention after tampering wherein the lid 20 has been removed from the base 10, as evidenced by the bonded tab marker 38 being left on the lid surface 21 and the tab 30 being biased away from the same. FIG. 10 shows a preferred embodiment of the present invention after tampering wherein the lid 20 has been returned to its original seated position on the base 10, thereby sealing the enclosure 12 once more.

Figure 11A:
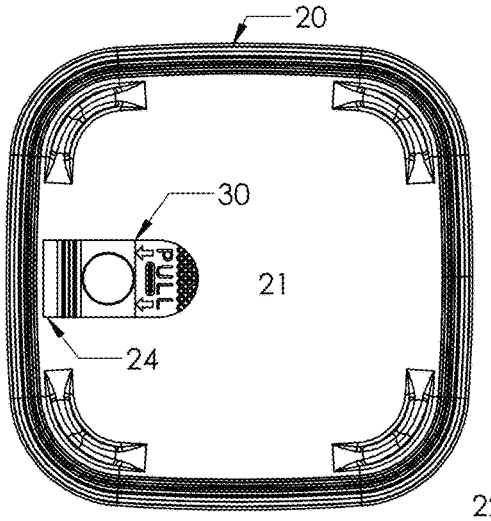
FIG. 11A is a top elevational view of a lid and a tab of a container provided in accordance with an alternative preferred embodiment of the present invention, the tab shown bonded to an alternative location on the lid.
Figure 11B:
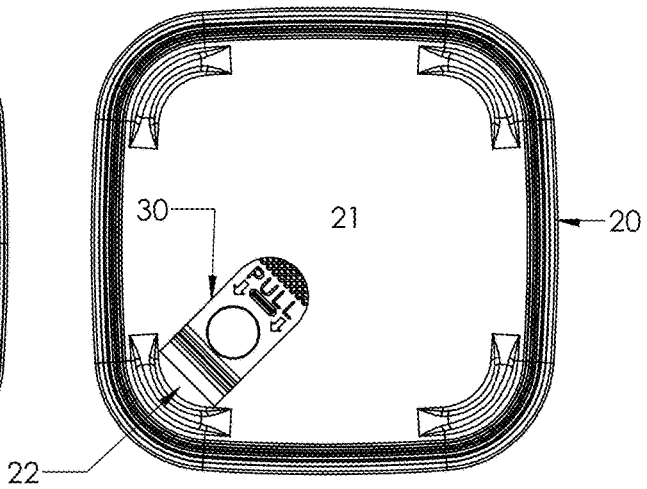
FIG. 11B is a top elevational view of a lid and a tab of a container provided in accordance with an alternative preferred embodiment of the present invention, the tab shown bonded to an another alternative location on the lid.
Figure 11C:
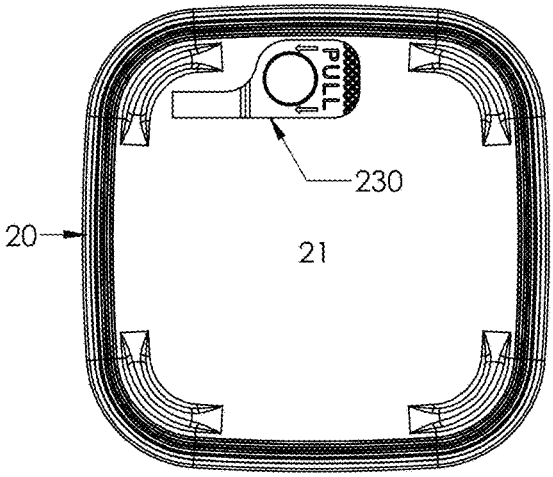
FIG. 11C is a top elevational view of a lid and a tab of a container provided in accordance with an alternative preferred embodiment of the present invention, showing an alternative tab structure bonded to a location on the lid.
Figure 11D:
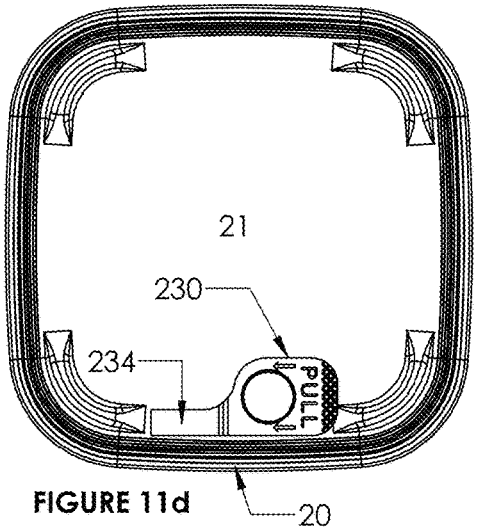
FIG. 11D is a top elevational view of a lid and a tab of a container provided in accordance with an alternative preferred embodiment of the present invention, showing an alternative tab structure bonded to another location on the lid.
Figure 11E:
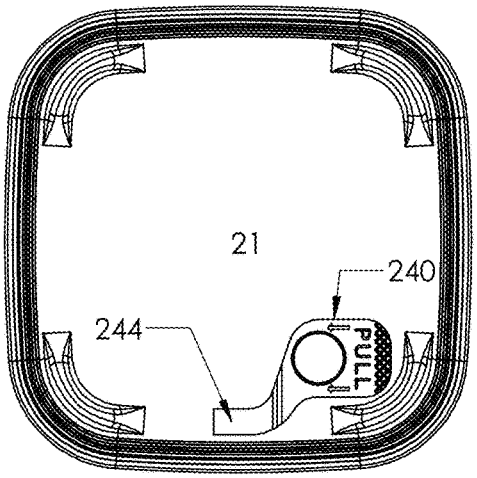
FIG. 11E is a top elevational view of a lid and a tab of a container provided in accordance with an alternative preferred embodiment of the present invention, showing another alternative tab structure bonded to a location on the lid.

FIGS. 11A-E show alternative preferred embodiments provided in accordance with the present invention. As shown, the tab 30 may be bonded at preferred locations on the lid surface 21. These locations include, without limitation, at one of the middle lid edge 24 as shown in FIG. 11A, and at the lid corner 22 as shown in FIG. 11B. Moreover, alternative embodiments of a tab may be provided, such as a tab 230 as shown in FIG. 11C-D, and a tab 240 as shown in FIG. 11E. Each of the tabs 230 and 240 include features that are the same as tab 30 as defined above and shown at, inter alia, FIG. 4, although as shown in FIG. 11C-D a first tab portion 231 is preferably truncated as shown. Similarly, as shown in FIG. 11E, a first tab portion 241 of tab 240 is substantially curved as shown, wherein a bonded tab base 244 is preferably offset from second and third tab portions 242, 243. In the alternative preferred embodiment of FIG. 11E, the bonded tab base 244 is preferably bonded to the lid surface 21 at the middle lid edge 24, whereas the second and third tab portions 242, 243 are provided in the offset position noted above that is preferably further away from the middle lid edge 24 and toward a center of the lid surface 21 than is the bonded tab base 244.

It has been found that, surprisingly, preferred embodiments of the present invention that include a tab 30, 230, 240 having its respective bonded tab base 34, 234, 244 provided at the middle lid edge 24, as opposed to the lid corner 22, results in a reduction of force required to unseat the lid 20 from the base 10 during normal use of the container 1. This is because pulling the tab 20 at the middle lid edge 24 location allows the lid 20 to flex upward along a middle portion of edge 24, which allows for the two adjacent (or corners closest to the tab) corners 22 to slide inward and upward, thereby reducing frictional force of the interference fit at both corners. See FIGS. 20A-D. The corners 22 are the most rigid members of the lid 20, so this dynamic reduces the force required to retain the lid 20 on the base 10. If the tab 20 is located in the corner 22, which is where most packaging tabs are located, then the corner 22 is lifted mostly upward and must overcome nearly all of the interference between the lid 20 and base 10. This results in a higher force required to remove the lid 20 from the base 10. Therefore, the tab 30 being a separate article that is not integrally formed with the lid 20 and that may be bonded at myriad preferred locations about the lid surface 21 is advantageous because the tab 30 is therefore suitable and adaptable for myriad lid 20 applications comprising a wide array of shapes and sizes. In other words, preferred embodiments of the present invention are neither confined to a particular orientation of the tab 30 about the lid surface 21, nor is the container 1 and its constituent base 10 and lid 20 confined to a particular geometry.

Figure 12A:
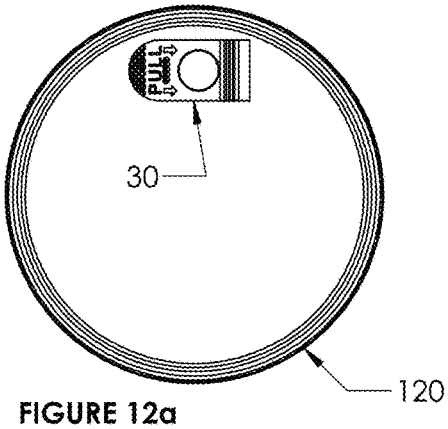
FIG. 12A is a top elevational view of a lid and a tab of a container provided in accordance with another alternative preferred embodiment of the present invention, the lid shown as being substantially round.
Figure 12B:
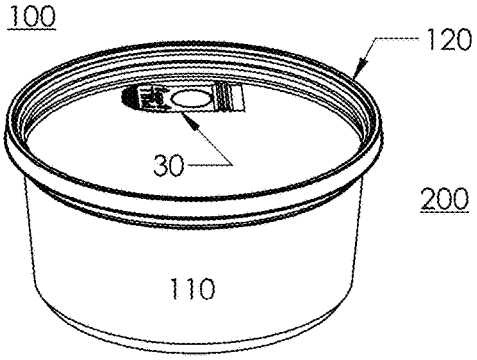
FIG. 12B is a perspective view of container provided in accordance with another alternative preferred embodiment of the present invention, the container shown as being substantially round.
Figure 12C:
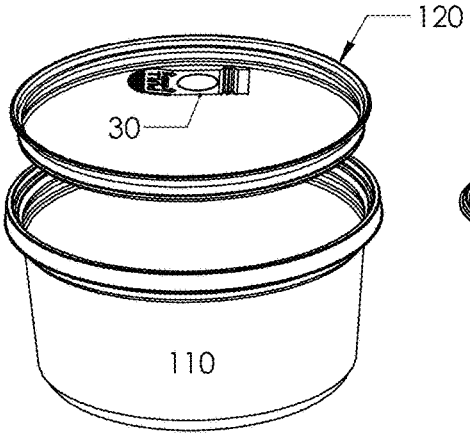
FIG. 12C is an exploded perspective view of container provided in accordance with another alternative preferred embodiment of the present invention, the container shown as being substantially round.

As shown in FIGS. 12A-C, an alternative preferred embodiment provided in accordance with the present invention comprises a lid 120 having a substantially round shape and footprint as shown in FIG. 12A. A container 100 preferably comprises the lid 120 coupled with tab 30 and base 110, as shown in FIGS. 12B-C.

Figure 13A:
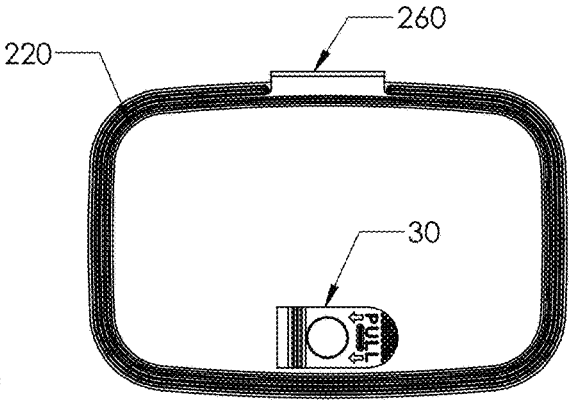
FIG. 13A is a top elevational view of a lid and a tab of a container provided in accordance with yet another alternative preferred embodiment of the present invention, the lid shown as being substantially rectangular and comprising a hinge portion.
Figure 13B:
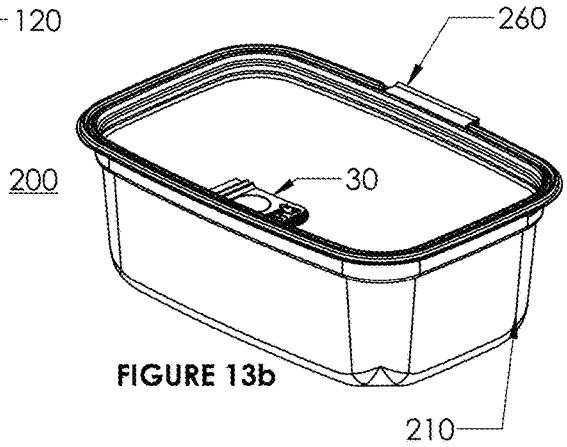
FIG. 13B is a perspective view of a container provided in accordance with yet another alternative preferred embodiment of the present invention, the container shown as being substantially rectangular and comprising a hinge.
Figure 13C:
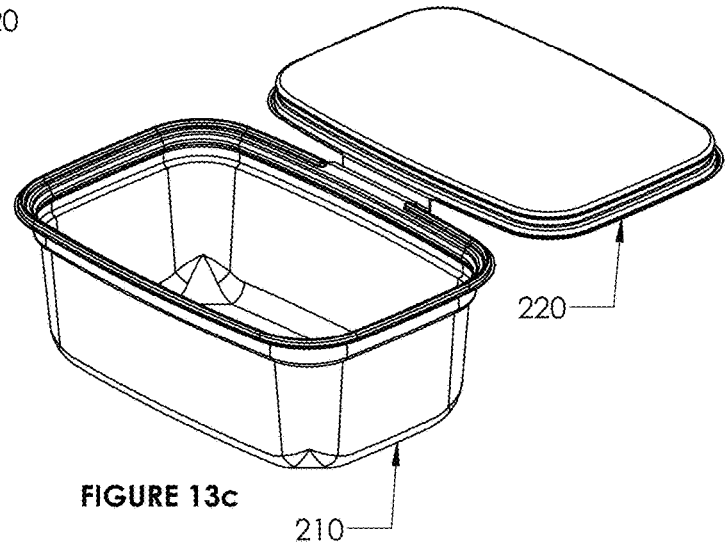
FIG. 13C is an exploded perspective view of a container provided in accordance with yet another alternative preferred embodiment of the present invention, the container shown as being substantially rectangular and comprising a hinge.

As shown in FIGS. 13A-C, an alternative preferred embodiment provided in accordance with the present invention comprises a lid 220 having a rectangular shape and footprint as shown in FIG. 13A. A container 200 preferably comprises the lid 220 coupled with tab 30 and base 210, as shown in FIGS. 13B-C. In some preferred embodiments of the present invention, the container 200 further comprises a hinge 260 to provide the container 200 having a clamshell configuration.

Figure 14A:
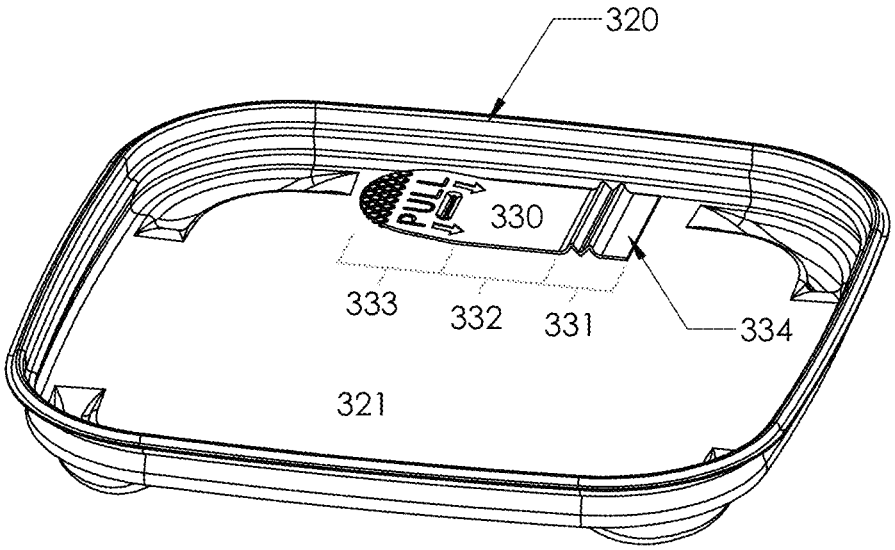
FIG. 14A is a perspective view of a lid and a tab of a container provided in accordance with an alternative preferred embodiment of the present invention, the tab comprising tamper tape and being shown prior to tampering.
Figure 14B:
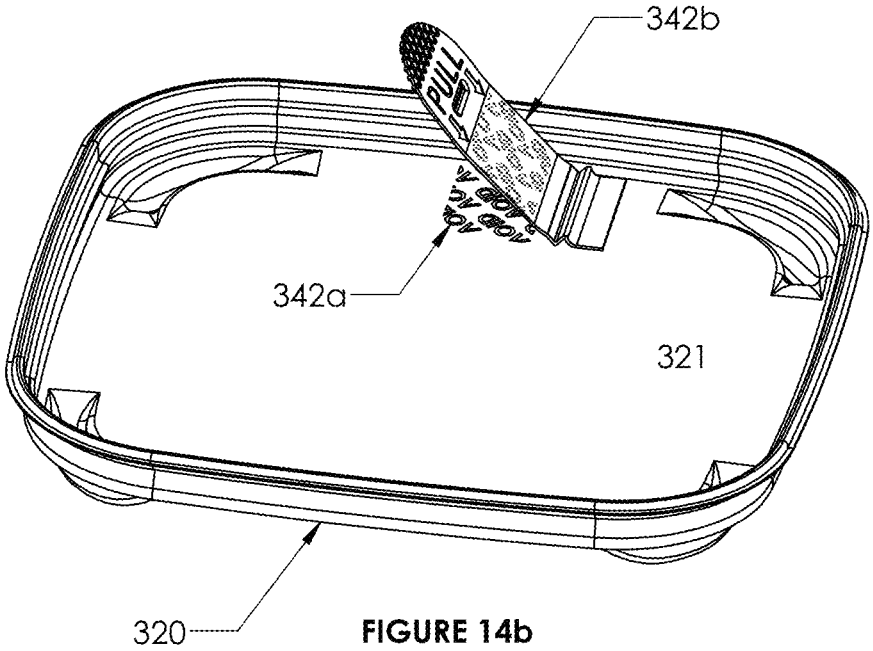
FIG. 14B is a perspective view of a lid and a tab of a container provided in accordance with an alternative preferred embodiment of the present invention, the tab comprising tamper tape and being shown after tampering.

FIGS. 14A-B illustrate an alternative preferred embodiment of the present invention comprising a lid 320 and a tab 330. The tab 330 comprises a first tab portion 331, a second tab portion 332, and a third tab portion 333. The first tab portion 331 and the third tab portion 333 preferably comprise the same features and alternatives as described above for the first tab portion 31 and the third tab portion 33, respectively, of tab 30. Second tab portion 332, however, comprises a tamper tape 342*a,b*, instead of a bonded tab marker 38 and bridge 36. In some preferred embodiments, the tamper tape 342*a,b* comprises a two-sided adhesive on film provided between the lid surface 321 and the second tab portion 332, the film configured to be pulled apart to demonstrate evidence of tampering. As shown in FIG. 14A, prior to tampering, tab 330 may be bonded to lid surface 321 at a bonded tab base 334 of the first tab portion 331 by welding or a suitable adhesive. In the alternative preferred embodiment as shown in FIGS. 14A-B, the tab 330 is also bonded to the lid surface 321 by the tamper tape 342*a,b*, which comprises an adhesive. As shown in FIG. 14A after tab 330 is pulled away from a lid surface 321, i.e., after tampering, the tamper tape 342*a,b* fractures and leaves evidence of tampering on the lid surface 321. In some embodiments, such evidence may include the word "VOID" provided as shown in FIG. 14A. It is contemplated, however, that such evidence may include alternative indicia such as other words and/or symbols suited to the aforementioned purpose. Additionally, in alternative preferred embodiments, the tamper tape 342*a,b* may include a color feature, wherein the tape 342*a,b* appear to be one color when it is applied. Then, once tampering with the tape 342*a,b* has occurred, the tape 342*a,b* demonstrates distinct color changes as overt evidence of tampering, thereby making it nearly impossible to cover up such tampering evidence.

Figure 15A:
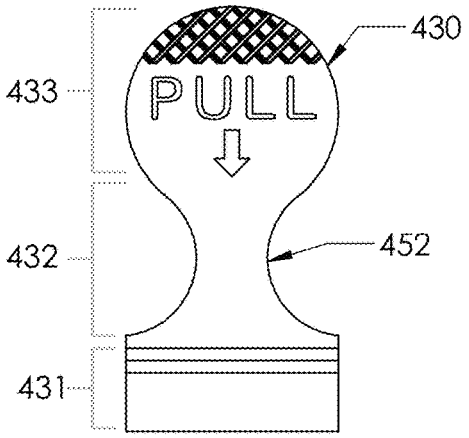
FIG. 15A is a front view of a tab of a container provided in accordance with an alternative preferred embodiment of the present invention, the tab comprising a narrow portion.
Figure 15B:
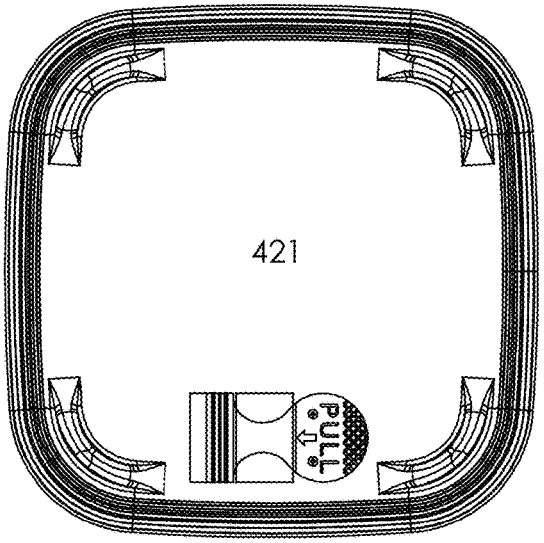
FIG. 15B is a top elevational view of a lid and a tab of a container provided in accordance with an alternative preferred embodiment of the present invention, the tab comprising a narrow portion and tamper tape, and the tab being shown prior to tampering.
Figure 15C:
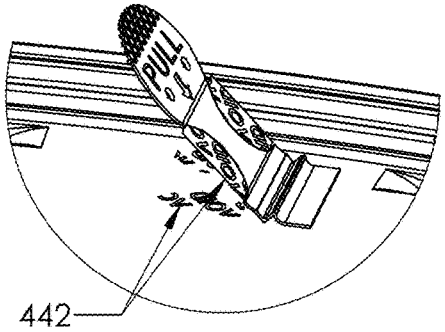
FIG. 15C is a perspective view of a lid and a tab of a container provided in accordance with an alternative preferred embodiment of the present invention, the tab comprising a narrow portion and tamper tape, and the tab being shown after tampering.
Figure 15D:
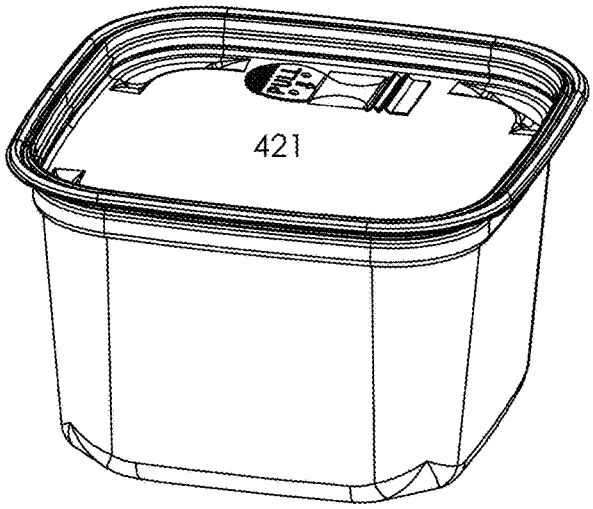
FIG. 15D is a perspective view of a lid, a tab, and a base of a container provided in accordance with an alternative preferred embodiment of the present invention, the tab comprising a narrow portion and tamper tape, and the tab being shown prior to tampering.
Figure 15E:
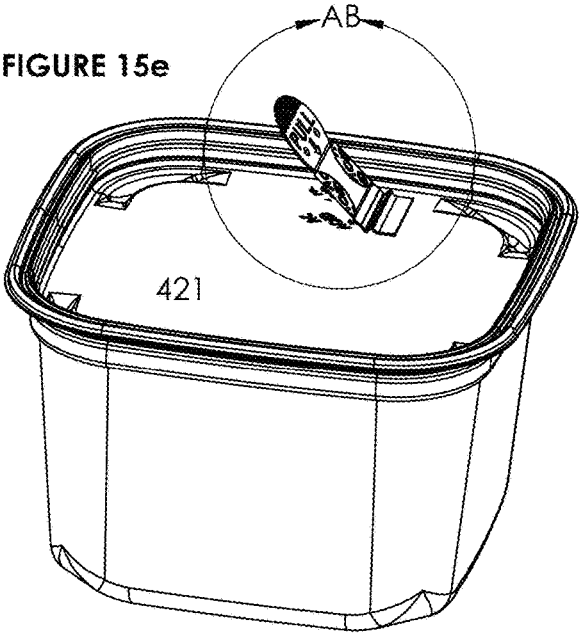
FIG. 15E is a perspective view of a lid, a tab, and a base of a container provided in accordance with an alternative preferred embodiment of the present invention, the tab comprising a narrow portion and tamper tape, and the tab being shown after tampering.

FIGS. 15A-E illustrate an alternative preferred embodiment of the present invention comprising a tab 430. As shown, tab 430 is an alternative tab 430 structure comprising a first tab portion 431, a second tab portion 432, and a third tab portion 433. The first tab portion 431 preferably comprises the same features and alternatives as described above for the first tab portion 31 of tab 30. In this embodiment, however, the third tab portion 433 is substantially arcuate, and the second portion 432 comprises a narrow portion 452 and tamper tape 442. The tamper tape 442 is preferably a single-sided adhesive provided over the narrow portion 452, such that the tamper tape 442 adheres to the narrow portion 452 and lid surface 421 prior to tampering, as shown in FIGS. 15B and 15D. As shown in FIGS. 15C and 15E, after tab 430 is pulled away from a lid surface 421, i.e., after tampering, the tamper tape 442 fractures and leaves evidence of tampering on the lid surface 421. This structure obviates a need for double-sided tamper tape, as desired.

FIGS. 16A-E illustrate alternative preferred embodiments of tabs provided in accordance with the present invention. As shown in the preferred embodiment of FIG. 16A, the tab 530 is preferably a separate article that is not integrally formed with lid 520. Instead, the tab 530 is bonded to the lid 520 at a preferred location. The tab 530 preferably comprises a first portion 531, a second portion 532, and a third portion 533. The first tab portion 531 preferably comprises a bonded tab base 534. The second tab portion 532 preferably comprises a bonded tab marker 538. The bonded tab base 534 and the bonded tab marker 538 are bonded at any location to lid surface 521 preferably by a welding process, such as ultrasonic welding, or other bonding mechanism, including the use of an adhesive. The third tab portion 533 preferably comprises at least one detent 539. The tab 530 further comprises a frangible line 537 that emanates between portions 532 and 533, as shown in FIG. 16A, and terminates in portion 531. During normal operation, a user may pull the tab 530 at portion 533 wherein the frangible line 537 will break, and the tab 530 is detached from the lid surface 521 at portion 533 while the tab 530 remains bonded to the lid surface 521 at portions 531 and 532, including at the bonded tab marker 538 of portion 532 to provide overt evidence of tampering on lid surface 521.

As shown in the preferred embodiment of FIG. 16B, the tab 630 is preferably a separate article that is not integrally formed with lid 620. Instead, the tab 630 is bonded to the lid 620 at a preferred location. The tab 630 preferably comprises a first portion 631, a second portion 632, and a third portion 633. The first tab portion 631 preferably comprises a first bonded tab base 634. The second tab portion 632 preferably comprises a second bonded tab base 639. The third tab portion 633 preferably comprises a bridge 636 that is separably attached to a bonded tab marker 638 at frangible line 637. The bonded tab bases 634, 639 and the bonded tab marker 638 are bonded at any location to lid surface 621 preferably by a welding process, such as ultrasonic welding, or other bonding mechanism, including the use of an adhesive. During normal operation, a user may pull the tab 630 at portion 633 wherein the frangible line 637 will break, and wherein the tab 630 is detached from the lid surface 621 at portion 633 while the tab 630 remains bonded to the lid surface 621 at portions 631 and 632, including leaving behind on the lid surface 621 the bonded tab marker 638 of portion 633 to provide overt evidence of tampering on lid surface 621.

As shown in the preferred embodiment of FIG. 16C, the tab 730 is preferably a separate article that is not integrally formed with lid 720. Instead, the tab 730 is bonded to the lid 720 at a preferred location. The tab 730 preferably comprises a first portion 731, a second portion 732, and a third portion 733. The first tab portion 731 preferably comprises a bonded tab base 734. The second tab portion 732 preferably comprises a bonded tab marker 738. The bonded tab base 734 and the bonded tab marker 738 are bonded at any location to lid surface 721 preferably by a welding process, such as ultrasonic welding, or other bonding mechanism, including the use of an adhesive. The tab 730 further comprises a frangible line 737 that emanates between portions 732 and 733, as shown in FIG. 16C, and terminates in portion 731. During normal operation, a user may pull the tab 730 at portion 733 wherein the frangible line 737 will break, and wherein the tab 730 is detached from the lid surface 721 at portion 733 while the tab 730 remains bonded to the lid surface 721 at portions 731 and 732, including at the bonded tab marker 738 of portion 732 to provide overt evidence of tampering on lid surface 721.

As shown in the preferred embodiment of FIG. 16D, the tab 830 is preferably a separate article that is not integrally formed with lid 820. Instead, the tab 830 is bonded to the lid surface 821 at a preferred location. Tab 830 is preferably comprised of a pull tab portion 833, a frangible line 837, and a bonded tab marker 838.

As shown in the preferred embodiment of FIG. 16E, the tab 930 is preferably a separate article that is not integrally formed with lid 920. Instead, the tab 930 is bonded to the lid surface 921 at a preferred location. Tab 930 is preferably comprised of a pull tab portion 933, a frangible line 937, and a bonded tab marker 938.

Figure 17A:
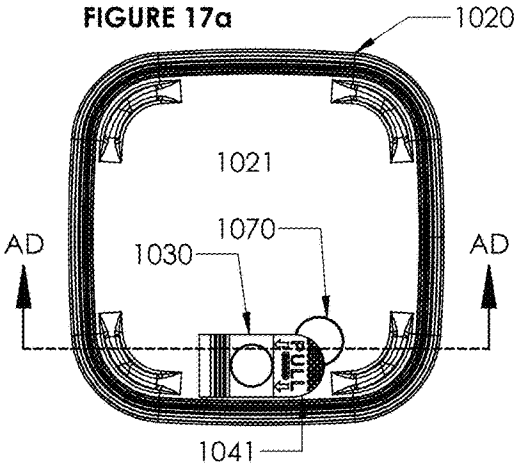
FIG. 17A is a top elevational view of a lid and a tab of a container provided in accordance with an alternative embodiment of the present invention and including section line AD-AD, the lid comprising a detent.
Figure 17B:
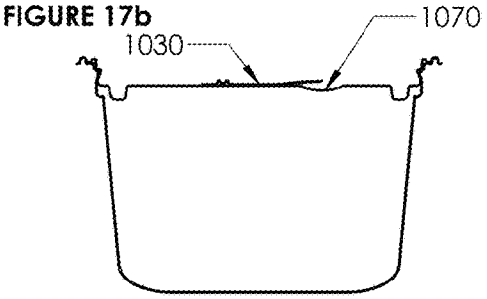
FIG. 17B is a cross-sectional view on section line AD-AD of a lid, a tab, and a base of a container provided in accordance with an alternative embodiment of the present invention, the lid comprising a detent.
Figure 17C:
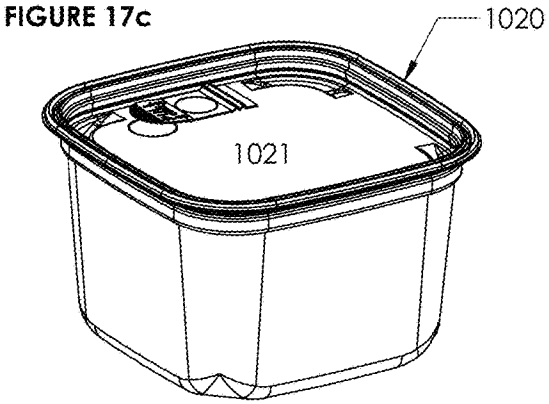
FIG. 17C is a perspective view of a lid and a tab, and a base of a container provided in accordance with an alternative embodiment of the present invention, the lid comprising a detent.

FIGS. 17A-C illustrate alternative preferred embodiments of a tab 1030 and lid 1020 structure provided in accordance with the present invention. As shown in FIGS. 17A-C, tab 1030 has the same structure as tab 30 described above. In this embodiment, however, lid 1020 further comprises a detent 1070 to provide enhanced access to gripping area 1041 by a user's fingers. The tab 1030 is preferably a separate article that is not integrally formed with lid 1020. Instead, the tab 1030 is bonded at any location to lid surface 1021 preferably by a welding process, such as ultrasonic welding, or other bonding mechanism, including the use of an adhesive.

Figure 18A:
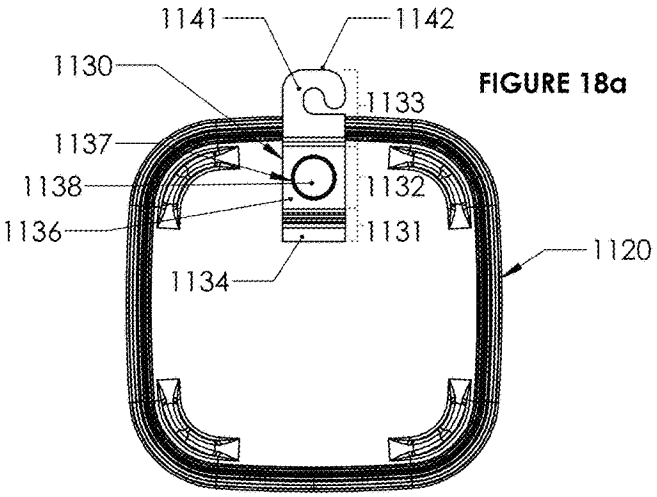
FIG. 18A is a top elevational view of a lid and a tab of a container provided in accordance with an alternative embodiment of the present invention, the tab comprising a hanging portion.
Figure 18B:
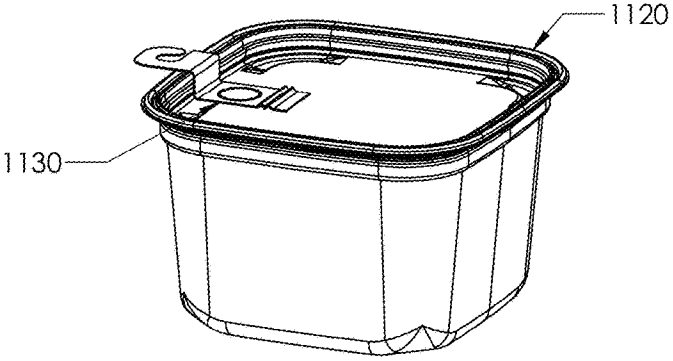
FIG. 18B is a perspective view of a lid and a tab, and a base of a container provided in accordance with an alternative embodiment of the present invention, the tab comprising a hanging portion.

FIGS. 18A-B illustrate alternative preferred embodiments of a tab 1130 and lid 1120 structure provided in accordance with the present invention. FIGS. 18A-B illustrate alternative preferred embodiments of a tab 1130 and lid 1120 structure provided in accordance with the present invention. The tab 1130 is preferably a separate article that is not integrally formed with lid 1120. Instead, the tab 1130 is bonded to the lid 1120 at a preferred location. The tab 1130 preferably comprises a first portion 1131, a second portion 1132, and a third portion 1133. The first tab portion 1131 preferably comprises a first bonded tab base 1134. The second tab portion 1133 preferably comprises a bridge 1136 that is separably attached to a bonded tab marker 1138 at frangible line 1137. The third tab portion 1133 preferably comprises a hanging portion 1141. As shown in FIG. 18B, hanging portion 1141 preferably extends by a series of approximately 90 degree bends to a distal most portion 1142, wherein the hanging portion 1141 is preferably outside the footprint of the lid 1120, as best shown in FIG. 18A. The bonded tab base 1134 and the marker 1138 are bonded at any location to lid surface 1121, preferably by a welding process, such as ultrasonic welding, or other bonding mechanism, including the use of an adhesive. During normal operation, a user may pull the tab 1130 at portion 1133 wherein the frangible line 1137 will break around the marker 1138, thereby leaving behind on the lid surface 1121 the marker 1138 to provide overt evidence of tampering on lid surface 1121.

Figure 19C:
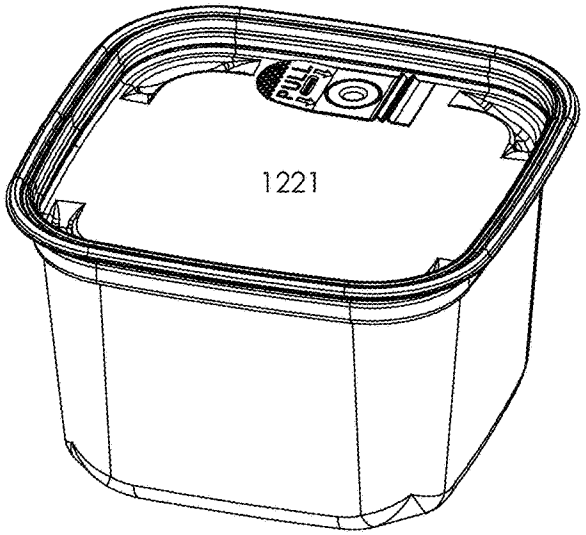
FIG. 19C is a perspective view of a lid, a tab, and a base of a container provided in accordance with an alternative embodiment of the present invention, the tab comprising a post and the lid comprising a post receptacle, the tab shown prior to tampering.
Figure 19D:
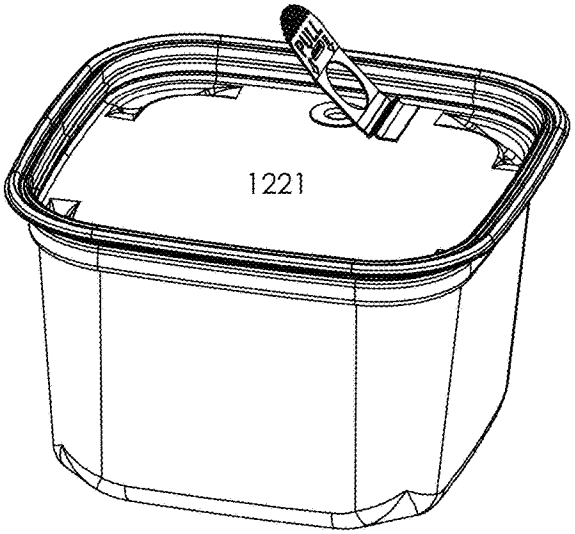
FIG. 19D is a perspective view of a lid, a tab, and a base of a container provided in accordance with an alternative embodiment of the present invention, the tab comprising a post and the lid comprising a post receptacle, the tab shown after tampering.
Figure 19A:
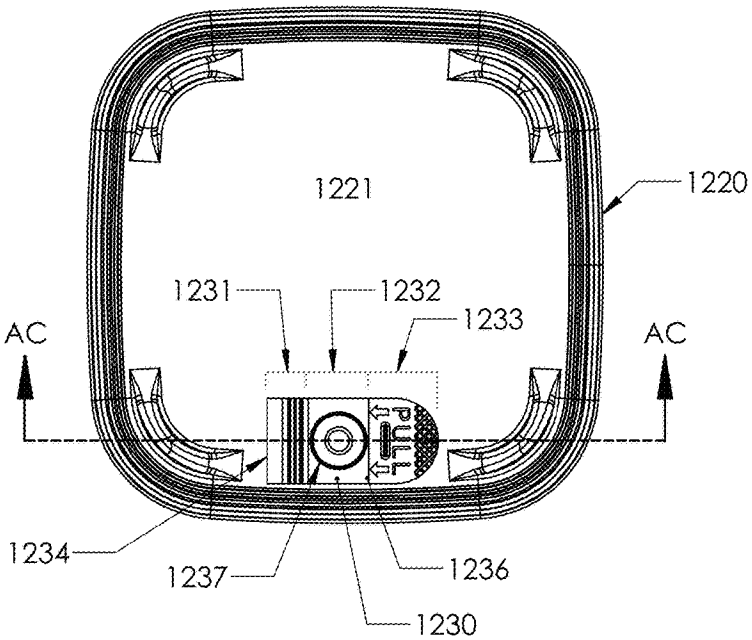
FIG. 19A is a top elevational view of a lid and a tab of a container provided in accordance with an alternative embodiment of the present invention and including section line AC-AC, the tab comprising a post and the lid comprising a post receptacle.
Figure 19B:
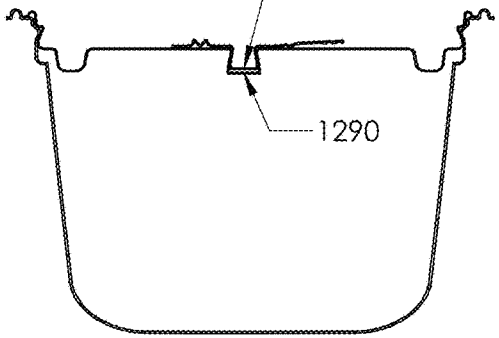
FIG. 19B is a cross-sectional view on section line AC-AC of a lid, a tab, and a base of a container provided in accordance with an alternative embodiment of the present invention, the tab comprising a post and the lid comprising a post receptacle.
Figure 20A:
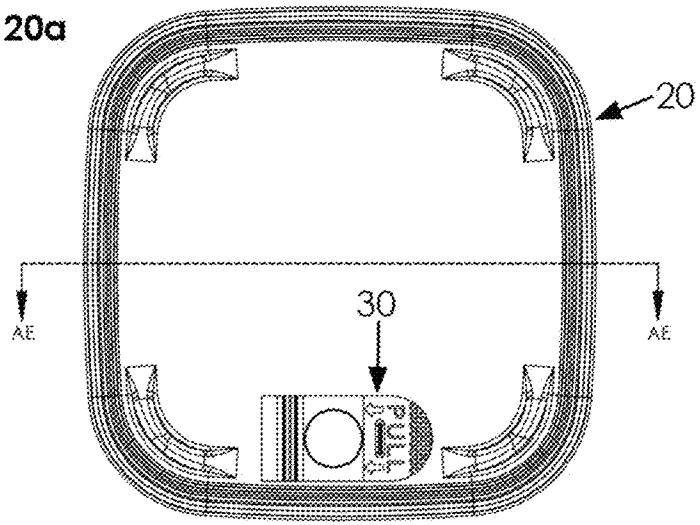
FIG. 20A a top elevational view of a lid and a tab of a container provided in accordance with an alternative embodiment of the present invention including section line AE-AE.
Figure 20C:
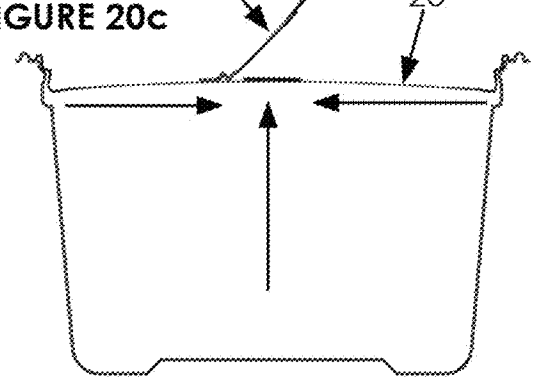
FIG. 20C is a cross-sectional view is a cross-sectional view on section line AE-AE of a lid, a tab, and a base of a container provided in accordance with an alternative embodiment of the present invention, the tab shown after tampering and the lid shown flexing inwardly at corners of the lid.
Figure 20D:
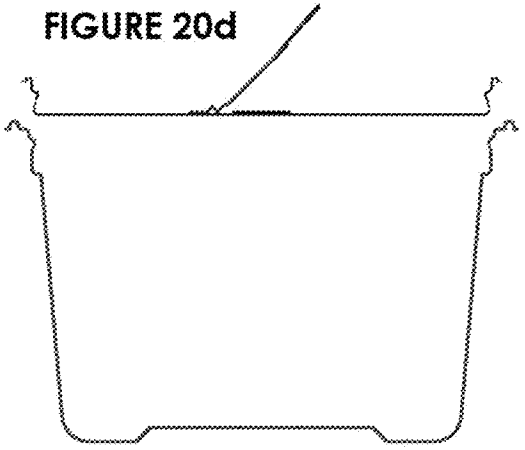
FIG. 20D is a cross-sectional view is a cross-sectional view on section line AE-AE of a lid, a tab, and a base of a container provided in accordance with an alternative embodiment of the present invention, the container shown in an open condition after the lid has been removed using the tab.
Figure 20B:
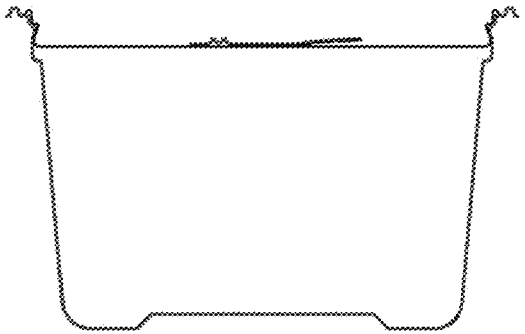
FIG. 20B is a cross-sectional view is a cross-sectional view on section line AE-AE of a lid, a tab, and a base of a container provided in accordance with an alternative embodiment of the present invention, the container shown in a sealed condition.

FIGS. 19A-D illustrate alternative preferred embodiments of a tab 1230 and lid 1220 structure provided in accordance with the present invention. The tab 1230 is preferably a separate article that is not integrally formed with lid 1220. Instead, the tab 1230 is bonded to the lid 1220 at a preferred location. The tab 1230 preferably comprises a first portion 1231, a second portion 1232, and a third portion 1233. The first tab portion 1231 preferably comprises a first bonded tab base 1234. The second tab portion 1233 preferably comprises a bridge 1236 that is separably attached to a post 1280 at frangible line 1237. The bonded tab base 1234 is bonded at any location to lid surface 1221, wherein the post 1280 is configured to be provided in frictional engagement with a post receptacle 1290 of the lid 1220, as shown in FIG. 19B. The bonded tab base 1234 is bonded preferably by a welding process, such as ultrasonic welding, or other bonding mechanism, including the use of an adhesive. During normal operation, a user may pull the tab 1230 at portion 1233 wherein the frangible line 1237 will break around the post 1280, thereby leaving behind on the lid surface 1221 the post 1280 frictionally engaged with the post receptacle 1290 to provide overt evidence of tampering on lid surface 1221.

It is contemplated that a tab provided in accordance with the present invention may be used to provide merchandising information and/or coupons to consumers. It also contemplated that a tab provided in accordance with the present invention may comprise a spoon or other utensil, or a flavor button.

Figure 22:
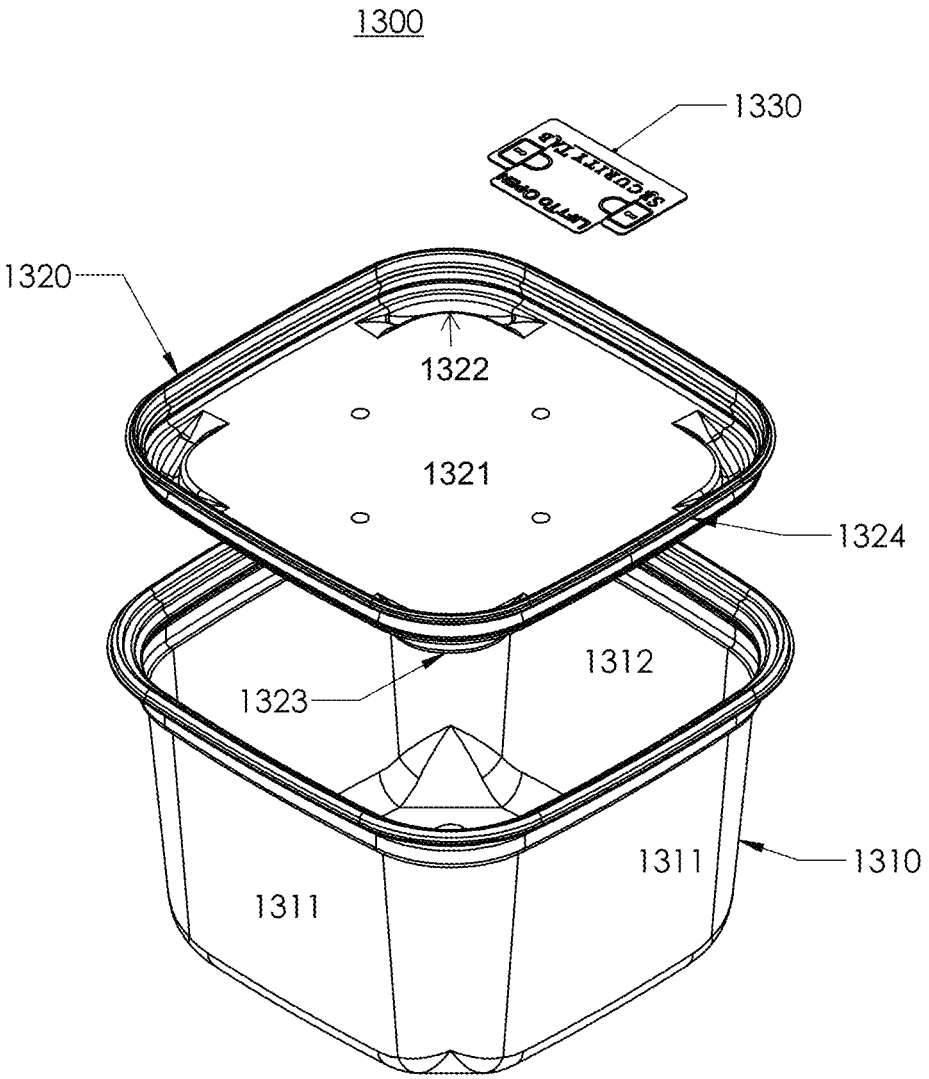
FIG. 22 is an exploded perspective view of a container provided in accordance with an alternative preferred embodiment of the present invention.

FIG. 22 shows a container 1300 provided in accordance with an alternative preferred embodiment of the present invention. As shown, container 1300 preferably comprises a base 1310, a lid 1320, and a tab 1330. The container 1300 is preferably comprised of a thermoplastic polymer, such as polyethylene terephthalate, and the container 1300 may be comprised of other materials suitable for use in thermoformed packaging applications, including polypropylene, high density polyethylene, polylactic acid, and polystyrene. As shown in FIG. 22, the base 1310 and the lid 1320 are preferably complementary structures, wherein the lid 1320 is configured to be removably attached to the base 1310. Additionally, as shown, when the lid 1320 is attached to the base 1310, the container 1300 may have a substantially cuboid shape, although other alternative preferred embodiments of the present invention may include a container comprising other shapes, such as a cylinder or alternative polyhedrons, as will be further discussed below. As such, alternative preferred embodiments of the present invention may be provided with a lid and a complementary base having at least one of myriad footprints, including substantially square, substantially rectangular, and substantially round.

As further shown in FIG. 22, the base 1310 of this alternative preferred embodiment of the present invention has a depth and comprises a plurality of walls 1311 that define a void suitable for containment of goods, such as food, or other articles as desired. The lid 1320 is preferably removably attached to the base 1310 to seal the void and define an enclosure 1312. The lid 1320 further comprises a lid surface 1321, lid corners 1322, a plurality of lid lugs 1323, and a plurality of middle lid edges 1324. Although the base 1310 and the lid 1320 are preferably made by a thermoforming process, such as injection molding, the tab 1330 is a separate article that is preferably formed by thermoforming, shaping, coining, or a strapping process. As will be discussed further below, in a preferred embodiment of the present invention, the tab 1330 is attached to the lid 1320 by welding, use of an adhesive, or other suitable mechanism for bonding thermoplastic components together, such as stitching, gluing, or heat sealing.

Figure 23:
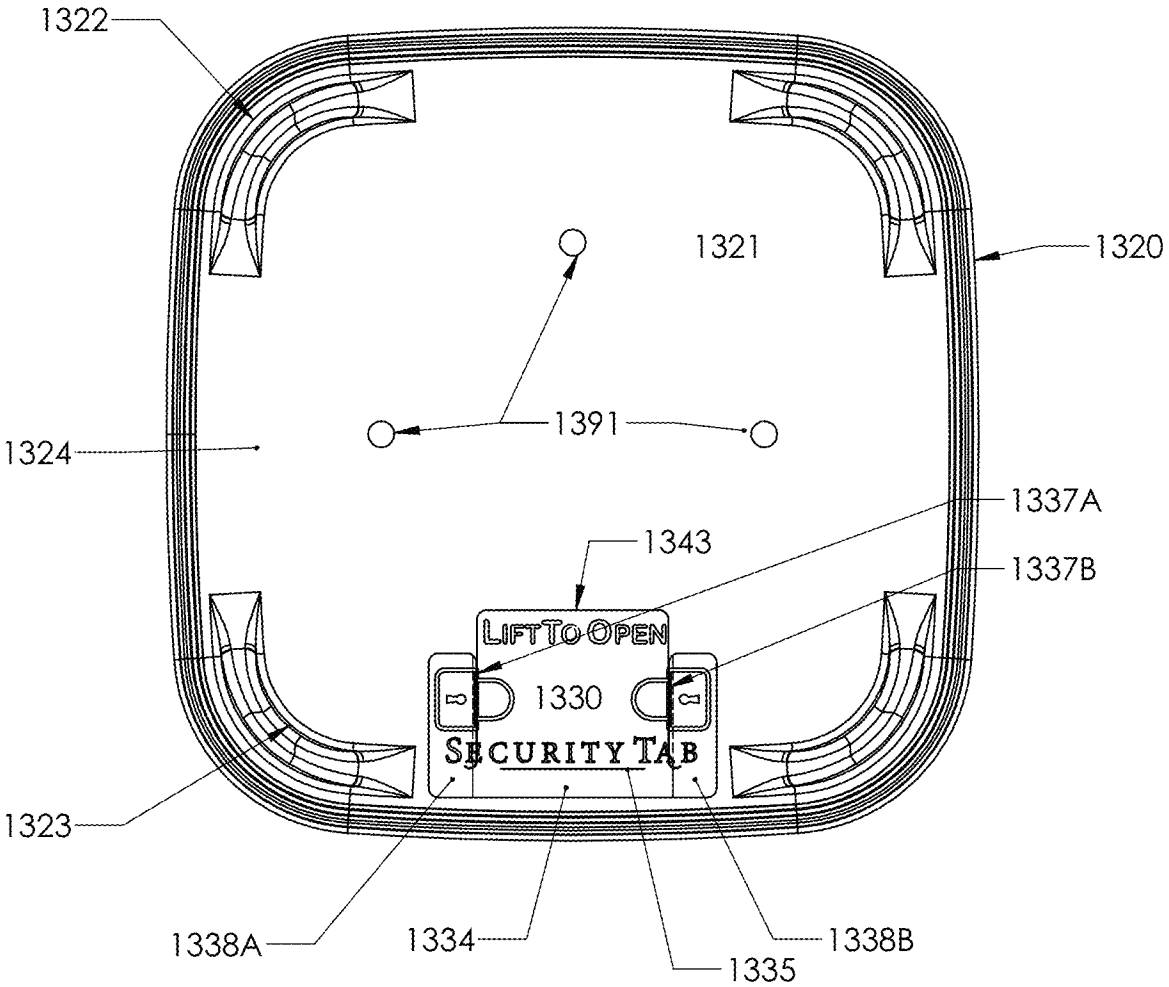
FIG. 23 is a top elevational view of a lid and a tab of a container provided in accordance with an alternative preferred embodiment of the present invention.

FIG. 23 shows the lid 1320 and the tab 1330 of the container 1300 provided in accordance with an alternative preferred embodiment of the present invention. As shown, the lid 1320 preferably comprises the lid surface 1321 and the plurality of lid lugs 1323 provided at the lid corners 1322 of the lid 1320. In alternative preferred embodiments that include one or more lugs 1323, the lugs 1323 have complementary configurations that are not limited by a particular geometry and that allow a plurality of lids 1320 to be neatly stacked on top of one another during storage and/or shipping wherein the lugs 1323 of one lid 1320 are nested with the lugs 1323 of other lids 1320 above and/or below it in the stack. Moreover, the lids 1320 may be removed neatly (i.e., dispensed) using automated equipment. Other alternative preferred embodiments of the present invention may exclude the lid lugs 1323 and lid corners 1322, the latter exclusion occurring such as when a container provided in accordance with the present invention is substantially cylindrical.

As further shown in the alternative preferred embodiment of FIG. 23, the tab 1330 is preferably a separate article that is not integrally formed with the lid 1320. Instead, the tab 1330 is bonded to the lid 1320 at a preferred location. As shown, the tab 1330 preferably comprises a pull tab portion 1333 having first and second sides 1336*a*, 1336*b*, a permanently bonded tab base 1334, a deflector 1335, first and second frangible lines 1337*a*, 1337*b*, and first and second bonded tab markers 1338*a*, 1338*b*.

As further shown in the alternative preferred embodiment of FIG. 23, the tab 1330 is bonded at the bonded tab base 1334 to the lid surface 1321. More specifically, the bonded tab base 1334 and the bonded tab markers 1338*a,b* are bonded to the lid surface 1321 preferably by a welding process, such as ultrasonic welding, or other bonding mechanism, including the use of an adhesive. The bonded tab base 1334 is preferably bonded to the lid surface 1321 along one of the middle lid edges 1324.

Figure 26A:
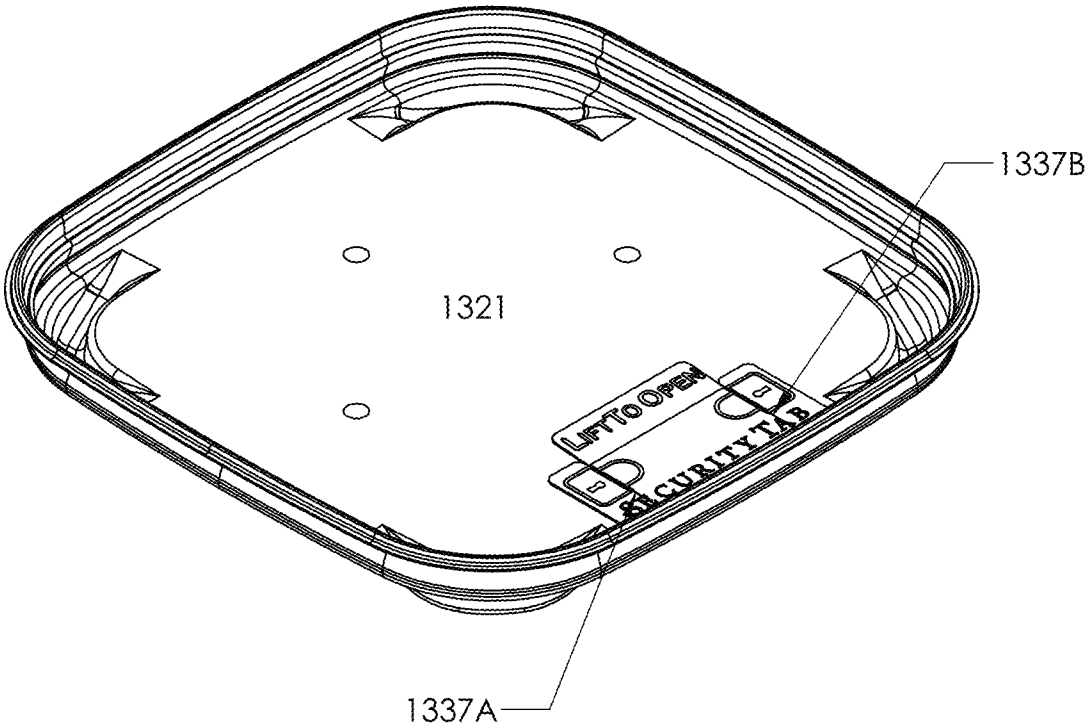
FIG. 26A is a perspective view of a lid and a tab of a container provided in accordance with an alternative preferred embodiment of the present invention, the tab being shown prior to tampering.

As yet further shown in the preferred embodiment of FIG. 23, the deflector 1335 is preferably a substantially ridged structure that extends transversely across the tab 1330. In an alternative preferred embodiment of the present invention, the pull tab portion 1333 further comprises a symbol, such as the words "LIFT TO OPEN" 1343 inscribed thereon. Alternative embodiments of the present invention may include other indicia at the pull tab portion 1333. Moreover, the pull tab portion 1333 and bonded tab markers 1338*a,b* may include indicia such as a padlock icon, wherein the shackle appears to be removed from the padlock body when the pull tab portion 1333 is pulled away from the bonded tab markers 1338*a,b* thus breaking frangible lines 1337*a,b*. See also FIGS. 26A and 26B. The breaking of the frangible lines 1337*a,b* is preferably tactilely evident to the user's fingers and preferably produces a "clicking" sound that is audible to the user, thereby providing the user with additional overt evidence of tamper protection, wherein the tactile sensation and audible sound produced by the breaking frangible lines 1337*a,b* is further confirmation that the container 1300 is being opened for the first time. Moreover, the indicia are configured to communicate visual evidence of container tampering to the user, wherein the appearance of the indicia is overtly altered after one or both of the frangible lines 1337*a,b* is broken, such as the aforementioned "breaking" of a padlock icon.

Figure 24:
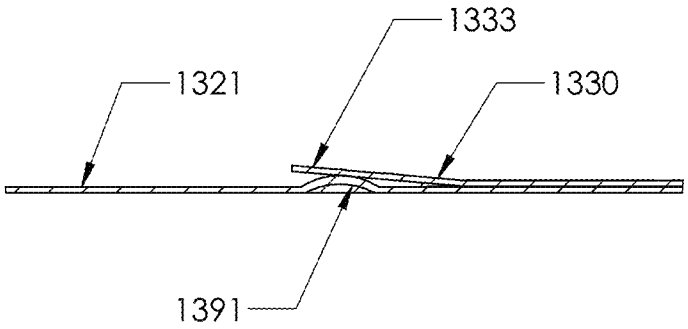
FIG. 24 is a cross-sectional view showing a lid and a tab of a container provided in accordance with an alternative preferred embodiment of the present invention, the tab shown prior to tampering.

As shown in FIGS. 23 and 24, lid surface 1321 comprises one or more detents 1391, which are preferably raised features on the lid surface 1321 that modestly biases the pull tab portion 1333 away from the lid surface 1321 for access by a user's finger before the tab 1330 is pulled away from the lid 1320. The detents 1391 are preferably overlaid by the pull tab portion 1333.

Figure 25:
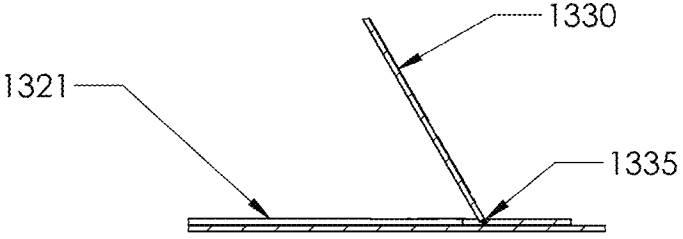
FIG. 25 is a cross-sectional view showing a lid and a tab of a container provided in accordance with an alternative preferred embodiment of the present invention, the tab shown after tampering.
Figure 26B:
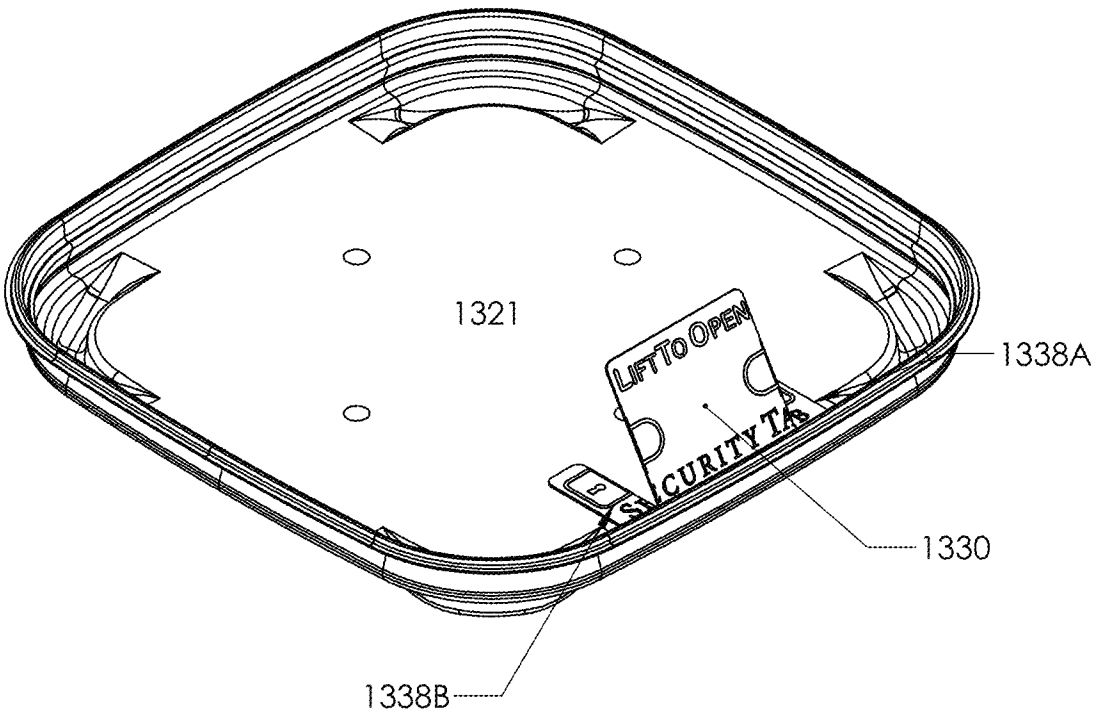
FIG. 26B is a perspective view of a lid and a tab of a container provided in accordance with an alternative preferred embodiment of the present invention, the tab comprising a narrow portion and tamper tape, and the tab being shown after tampering.

As shown in FIGS. 25, 26B, the tab 1330 is upwardly biased away from the lid 1320 after tampering, and the bonded tab markers 1338 are left behind and attached to the lid surface 1321. Once the tab 1330 is pulled open, the deflector 1335 helps to spring the tab 1330 up to show that it is separated from the lid surface 1321 and the bonded tab markers 1338*a,b*, thereby providing further overt evidence of lid 1320 tampering. It has been found that the act of pulling the tab 1330 creates a natural distortion and stress deformation at the bonded tab base 1334 that keeps the tab 1330 substantially biased away from the lid surface 1321 after tampering as shown in FIG. 25. The structure of deflector 1335 further supports this biasing away of the tab 1330 from the lid 1320 after tampering, such as after the first and second frangible lines 1337*a*, 1337*b* have been broken. This is particularly the case in alternative preferred embodiments that include the deflector 1335 further comprising cut through 1393, which is a transverse cut in the tab 1330 at the deflector 1335 which helps the tab 1330 to hinge upward and remain as such after tampering.

Figure 27B:
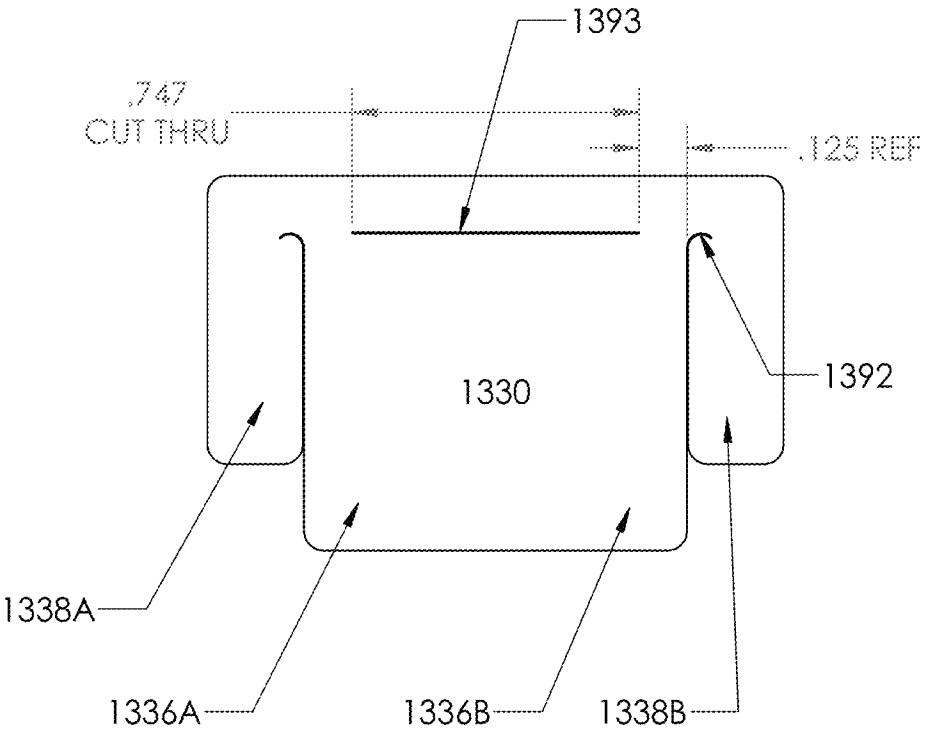
FIG. 27B is a perspective view of a tab of a container provided in accordance with an alternative preferred embodiment of the present invention, the tab shown without indicia and with frangible line termini provided in the shape of a "C".
Figure 27A:
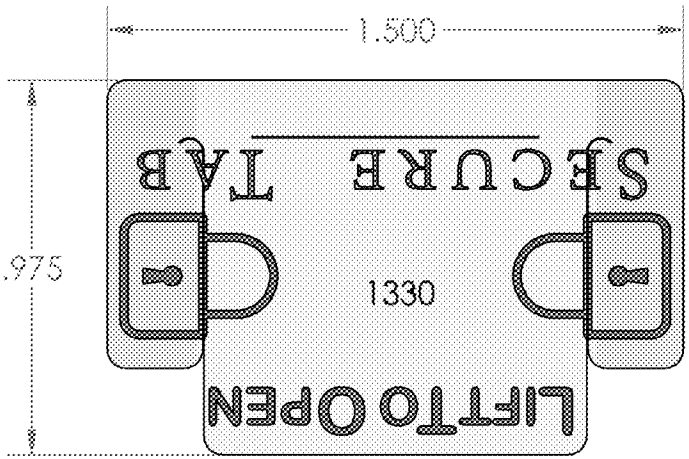
FIG. 27A is a perspective view of a tab of a container provided in accordance with an alternative preferred embodiment of the present invention, the tab shown with indicia thereon and frangible line termini provided in the shape of a "C".

As shown in FIGS. 27A and 27B, in at least one alternative embodiment of the present invention, tab 1330 preferably has a width of 1.5 inches and a depth of 0.975 inches. The bonded tab markers 1338*a,b* preferably have a width of 0.125 inches. Additionally, the frangible lines 1337*a,b* preferably comprise one or more termini 1392 having an arcuate shape, which helps to prevent the pull tab portion 1333 from detaching completely from the tab 1330 under the force of a user. This is because the force of the user pulling on the tab 1330 is radially transferred about the arcuate shape of the termini 1392, as opposed to continuing in a linear manner such that the pull tab portion 1343 may otherwise be removed entirely from the lid 1320, In some embodiments, the termini are provided in the shape of a "C". Tab 1330 may further comprise tamper tape.

We claim:

1. A tamper evident container comprising:

a base comprising a base seat;

a lid removably engaged with the base to provide a closed configuration of the container, the lid comprising a lid rim, a lid surface, a plurality of middle lid edges, and at least one detent;

a tab permanently attached to and substantially flush with the lid surface, the tab being a distinct and unitary article comprising a pull tab portion having a first side and a second side, a tab base, first and second tab markers, first and second frangible lines, and a deflector;

wherein the base seat is defined by a seat sidewall, a flange, and a rib corner;

wherein the lid rim is defined by a lid rim sidewall, a lid rim surface, and an outer edge;

wherein the lid rim sidewall contacts the seat sidewall under pressure from the engagement of the base and lid to form an interference fit such that the lid is immobilized in a seated position on the base, and the lid rim is consequently concealed within the structural boundaries of the base seat wherein the lid rim surface is held flush with the flange, and the outer edge is both adjacent to the rib corner and substantially inaccessible during normal use of the container when the container is in the closed configuration;

wherein the tab is permanently attached to the lid surface at each of the first and second tab markers and at the tab base, the tab base being located substantially parallel to and substantially adjacent to the center of one of the middle lid edges;

wherein the tab base and the pull tab portion are adjoined by the deflector, which is configured to cause the tab to be biased away from the lid surface once the first and second frangible lines are broken; and wherein the pull tab portion extends away from the tab base toward the center of the lid surface, the first side of the pull tab portion being separably attached to the first tab marker by the first frangible line, and the second side of the pull tab portion being separably attached to the second tab marker by the second frangible line, and the pull tab portion overlaying the at least one detent such that, notwithstanding the substantially flush engagement of the tab and the lid surface, the pull tab portion is marginally biased away from the lid surface to render the pull tab accessible by the user's finger.

2. The tamper evident container of claim 1, the first frangible line further comprising an arcuate terminus and the second frangible line further comprising an arcuate terminus.

3. The tamper evident container of claim 2, wherein both termini are substantially "C" shaped.

4. The tamper evident container of claim 1, the deflector further comprising a cut through which, in combination with the deflector, is configured to cause the tab to be biased away from the lid surface once the first and second frangible lines are broken.

5. The tamper evident container of claim 1, wherein a breaking of either or both of the first and second frangible lines produces a sound that is audible to the user.

6. The tamper evident container of claim 1, the lid further comprising a plurality of lid lugs and a plurality of detents.

7. The tamper evident container of claim 1, wherein the tab, being a distinct and unitary article, is permanently attached to the lid surface by welding, or other suitable mechanism for bonding together thermoplastic components.

8. The tamper evident container of claim 1, wherein the tab, being a distinct and unitary article, is permanently attached to the lid surface by use of an adhesive.

9. The tamper evident container of claim 1, wherein the lid is configured to be unseated from the base by a reduced force applied to the tab by the user during normal use of the container as compared to a greater force required to unseat the lid if the tab were provided in a different location on the lid because pulling the tab at the middle lid edge location allows the lid to flex inward and upward along a middle portion of the middle lid edge, which in turn allows for two corners of the container that are proximal to the tab to slide inward and upward, thereby reducing frictional force of the interference fit at both corners.

10. The tamper evident container of claim 1, the tab further comprising indicia configured to communicate visual evidence of container tampering to the user, wherein the appearance of the indicia is overtly altered after one or both of the frangible lines is broken.

11. The tamper evident container of claim 10, wherein a breaking of either or both of the first and second frangible lines produces a sound that is audible to the user, and the tab is thereby configured to provide at least five combined overt sensory indications to the user that the container is being opened for the first time, including: (i) visual evidence of non-tampering defined by (a) the outer edge of the lid rim being both adjacent to the rib corner of the base and substantially inaccessible by the user's fingers, (b) the pull tab portion being modestly biased away from the lid surface by the detent, notwithstanding the substantially flush engagement of the tab and the lid surface, or (c) the indicia having an unbroken and complete appearance; (ii) tactile evidence of non-tampering defined by an overt tactile sensation produced by the breaking of one or both of the frangible lines; and (iii) auditory evidence of non-tampering defined by the sound that is audible to the user when one or both of the frangible lines is broken.

12. A tamper evident container comprising:

a base comprising a base seat;

a lid removably engaged with the base to provide a closed configuration of the container, the lid comprising a lid rim, a lid surface, and a middle lid edge;

a tab permanently attached to and substantially flush with the lid surface, the tab being a distinct and unitary article comprising a first tab portion, a second tab portion, a third tab portion, wherein the first tab portion further comprises a tab base and a deflector, the second tab portion further comprises a frangible line, and a tab marker, and the third tab portion further comprises a detent;

wherein the base seat is defined by a seat sidewall, a flange, and a rib corner;

wherein the lid rim is defined by a lid rim sidewall, a lid rim surface, and an outer edge;

wherein the lid rim sidewall contacts the seat sidewall under pressure from the engagement of the base and lid such that the lid is immobilized in a seated position on the base, and the lid rim is consequently concealed within the structural boundaries of the base seat wherein the lid rim surface is held flush with the flange, and the outer edge is both adjacent to the rib corner and substantially inaccessible, during normal use of the container when the container is in the closed configuration;

wherein the tab is permanently attached to the lid surface at both of the tab marker and the tab base, the latter of which is located adjacent and substantially parallel to the middle lid edge; and wherein the second and third tab portions extend away from the tab base of the first portion and toward the center of the lid surface, the second portion being separably attached to the tab marker by the frangible line, and third tab portion having the detent, notwithstanding the substantially flush engagement of the tab and the lid surface, is marginally biased away from the lid surface to render the third tab portion accessible by the user's finger.

13. The tamper evident container of claim 11, wherein the deflector is configured to cause the tab to be biased away from the lid surface once the frangible line is broken.

14. The tamper evident container of claim 11, wherein when the frangible line is broken the tab marker remains permanently attached to the lid surface, and a bridge thereby defines a finger hole that was formerly occupied by the tab marker.

15. The tamper evident container of claim 11, wherein a breaking of the frangible line produces a sound that is audible to the user.

16. The tamper evident container of claim 11, wherein the tab, being a distinct and unitary article, is permanently attached to the lid surface by welding, or other suitable mechanism for bonding together thermoplastic components.

17. The tamper evident container of claim 11, wherein the tab, being a distinct and unitary article, is permanently attached to the lid surface by use of an adhesive.

18. The tamper evident container of claim 11, the third tab portion further comprising a grip.

19. The tamper evident container of claim 11, the tab further comprising indicia configured to communicate visual evidence of container tampering to the user, wherein the appearance of the indicia is overtly altered after the frangible line is broken.

20. The tamper evident container of claim 19, wherein a breaking of the frangible line produces a sound that is audible to the user, and the tab is thereby configured to provide at least five combined overt sensory indications to the user that the container is being opened for the first time, including: (i) visual evidence of non-tampering defined by (a) the outer edge of the lid rim being both adjacent to the rib corner of the base and substantially inaccessible by the user's fingers, (b) the third tab portion being modestly biased away from the lid surface by the detent, notwithstanding the substantially flush engagement of the tab and the lid surface, or (c) the indicia having an unbroken and complete appearance; (ii) tactile evidence of non-tampering defined by an overt tactile sensation produced by the breaking of the frangible line; and (iii) auditory evidence of non-tampering defined by the sound that is audible to the user when the frangible line is broken.

* * * * *